US009010787B2

(12) United States Patent
Slagerman et al.

(10) Patent No.: US 9,010,787 B2
(45) Date of Patent: Apr. 21, 2015

(54) TILT-IN-SPACE WHEELCHAIR USING MULTIPLE CONTROLLING PATHS

(71) Applicant: KI Mobility, Stevens Point, WI (US)

(72) Inventors: Murray G. Slagerman, Rosser (CA); Thomas J. Whelan, Stevens Point, WI (US); Richard E. Schneider, Cheyenne, WY (US); Douglas H. Munsey, Stevens Point, WI (US)

(73) Assignee: KI Mobility, Stevens Point, WI (US)

( * ) Notice: Subject to any disclaimer, the term of this patent is extended or adjusted under 35 U.S.C. 154(b) by 0 days.

(21) Appl. No.: 14/197,061

(22) Filed: Mar. 4, 2014

(65) Prior Publication Data

US 2014/0246841 A1 Sep. 4, 2014

Related U.S. Application Data

(60) Provisional application No. 61/772,386, filed on Mar. 4, 2013.

(51) Int. Cl.

| | |
|---|---|
| ***A61G 15/00*** | (2006.01) |
| ***A61G 5/10*** | (2006.01) |
| *A61G 5/12* | (2006.01) |

(52) U.S. Cl.

CPC ..... *A61G 5/1075* (2013.01); *A61G 5/1067* (2013.01); *A61G 5/107* (2013.01); *A61G 2005/128* (2013.01)

(58) Field of Classification Search

CPC ..... A61G 5/1056; A61G 5/107
USPC ..... 280/250.1
See application file for complete search history.

(56) References Cited

U.S. PATENT DOCUMENTS 144,603 A 11/1873 Enger
465,719 A 12/1891 Mitchell (Continued)

FOREIGN PATENT DOCUMENTS

DE 3805630 C1 7/1989
DE 10322958 A1 12/2004

(Continued)

OTHER PUBLICATIONS

PCT_Search_Report; Corresponding International Application PCT/US2014/020422.

(Continued)

*Primary Examiner* — Joseph Rocca
*Assistant Examiner* — Michael Stabley
(74) *Attorney, Agent, or Firm* — Endurance Law Group, PLC

(57) ABSTRACT

A wheelchair is disclosed herein. The wheelchair includes a base frame extending in a fore-aft direction and a lateral direction perpendicular to the fore-aft direction. The wheelchair also includes a plurality of wheels supporting the base frame for movement. The wheelchair also includes a seat frame operable to support a seat and a wheelchair occupant sitting in the seat. The wheelchair also includes a support assembly interconnecting the seat frame to the base frame for pivoting movement between an upright position, a fully-tilted position and an intermediate position between the upright position and the fully-tilted position. The support assembly utilizes a plurality of control paths to direct the seat frame in translating and rotating planar body motion that defines a fixed centrode. A center of gravity of the seat frame and the seat and the wheelchair occupant is definable in operation. In one aspect of the present disclosure, the plurality of control paths are arranged such that the center of gravity is directable during pivoting movement of the seat frame along a follower path being at least one of substantially horizontal and concave with the center of gravity vertically lower in the intermediate position than in at least one of the upright position and the fully-tilted position. In another aspect of the disclosure, the seat frame is adjustably positionable relative to the base frame in the fore-aft direction such that the position of the center of gravity is settable through adjust along a single axis to create an alignment of the center of gravity with the fixed centrode and thereby creates stability within the limits of the range of motion of the system.

19 Claims, 16 Drawing Sheets

(56) References Cited

U.S. PATENT DOCUMENTS

| | | | | |
|---|---|---|---|---|
| 2,195,428 | A | 2/1938 | Searing | |
| 2,313,023 | A | 9/1938 | Ruegger | |
| 2,153,763 | A | 4/1939 | Kuhler | |
| 2,245,713 | A | 6/1941 | Redmond | |
| 2,922,461 | A | 1/1960 | Braun | |
| 3,901,527 | A | 8/1975 | Danziger et al. | |
| 3,999,799 | A | 12/1976 | Daswick | |
| 4,462,604 | A | 7/1984 | Meyer | |
| 4,515,337 | A | 5/1985 | Torras | |
| 4,592,570 | A | 6/1986 | Nassiri | |
| 4,735,456 | A | 4/1988 | Haefelfinger | |
| 4,759,561 | A | 7/1988 | Janssen | |
| 4,790,599 | A | 12/1988 | Goldman | |
| 4,842,232 | A | 6/1989 | Pipon et al. | |
| 4,893,827 | A | 1/1990 | Gay et al. | |
| 4,957,302 | A | 9/1990 | Maxwell | |
| 5,044,647 | A | 9/1991 | Patterson | |
| 5,154,438 | A | 10/1992 | Barclay | |
| 5,267,745 | A | 12/1993 | Robertson et al. | |
| 5,292,144 | A | 3/1994 | Sosnoff | |
| 5,320,373 | A | 6/1994 | Robertson et al. | |
| 5,366,269 | A | 11/1994 | Beauvais | |
| 5,409,247 | A | 4/1995 | Robertson et al. | |
| 5,603,551 | A | 2/1997 | Sheehan | |
| 5,636,424 | A | 6/1997 | Singer et al. | |
| 5,785,384 | A | 7/1998 | Sagstuen | |
| 5,890,869 | A | 4/1999 | LeMaster et al. | |
| 5,964,473 | A | 10/1999 | Degonda et al. | |
| 5,967,609 | A | 10/1999 | Potter | |
| 5,971,482 | A | 10/1999 | Goertzen et al. | |
| 5,996,716 | A | 12/1999 | Montiglio et al. | |
| 6,003,891 | A | 12/1999 | Broadhead | |
| 6,012,774 | A | 1/2000 | Potter | |
| 6,032,976 | A | 3/2000 | Dickie et al. | |
| 6,050,642 | A | 4/2000 | Erb | |
| 6,056,363 | A | 5/2000 | Maddox | |
| 6,106,065 | A | 8/2000 | Carroll | |
| 6,126,186 | A | 10/2000 | Mascari | |
| 6,131,940 | A | 10/2000 | Arnoth | |
| 6,203,106 | B1 | 3/2001 | Nearing et al. | |
| 6,206,393 | B1 | 3/2001 | Mascari et al. | |
| 6,250,715 | B1 | 6/2001 | Caruso et al. | |
| 6,257,609 | B1 | 7/2001 | O'Neill, Sr. | |
| 6,270,111 | B1 | 8/2001 | Hanson et al. | |
| 6,276,704 | B1 | 8/2001 | Suiter | |
| 6,338,496 | B1 | 1/2002 | O'Neill, Sr. | |
| 6,357,776 | B1 | 3/2002 | Goertzen et al. | |
| 6,382,725 | B1 | 5/2002 | Carroll | |
| 6,409,265 | B1 | 6/2002 | Koerlin et al. | |
| 6,425,635 | B1 | 7/2002 | Pulver | |
| 6,447,064 | B1 | 9/2002 | Mundy et al. | |
| 6,450,578 | B1 | 9/2002 | Taggett | |
| 6,505,365 | B1 | 1/2003 | Hanson et al. | |
| 6,516,480 | B2 | 2/2003 | Elliott | |
| 6,641,214 | B2 | 11/2003 | Veneruso | |
| 6,705,629 | B2 | 3/2004 | Post et al. | |
| 6,776,430 | B2 | 8/2004 | White et al. | |
| 7,004,543 | B2 | 2/2006 | Caruso et al. | |
| 7,007,965 | B2 | 3/2006 | Bernatsky et al. | |
| 7,090,240 | B2 | 8/2006 | Papac | |
| 7,134,678 | B2 | 11/2006 | Lindkvist et al. | |
| 7,185,910 | B2 | 3/2007 | Beauchesne et al. | |
| 7,243,935 | B2 | 7/2007 | Beumer | |
| 7,404,567 | B2 | 7/2008 | Moller | |
| 7,425,037 | B2 | 9/2008 | Schmitz et al. | |
| 7,455,362 | B2 | 11/2008 | Hanson et al. | |
| 7,481,494 | B2 | 1/2009 | Sagstuen | |
| 7,516,977 | B2 | 4/2009 | Wu et al. | |
| 7,585,019 | B2 | 9/2009 | Huang et al. | |
| 7,600,817 | B2 | 10/2009 | Kramer et al. | |
| 7,845,665 | B2 | 12/2010 | Borisoff | |
| 7,871,094 | B2 | 1/2011 | Balcom et al. | |
| 7,905,504 | B2 | 3/2011 | Suddaby et al. | |
| 8,419,130 | B2 * | 4/2013 | Bergman | 297/316 |
| 8,474,848 | B2 | 7/2013 | Bernatsky et al. | |
| 2005/0116440 | A1 * | 6/2005 | Bernatsky et al. | 280/250.1 |
| 2009/0085324 | A1 | 4/2009 | Blauch et al. | |
| 2009/0283983 | A1 | 11/2009 | Horacek | |

FOREIGN PATENT DOCUMENTS

| | | | |
|---|---|---|---|
| EP | 350458 | A | 1/1990 |
| EP | 0788323 | B1 | 5/2002 |
| JP | S5628713 | | 3/1981 |
| JP | S5890150 | | 6/1983 |
| JP | H07237478 | | 9/1995 |
| JP | H07275073 | A | 10/1995 |
| JP | H0852039 | A | 2/1996 |
| JP | H10328241 | | 12/1998 |
| JP | 2001129026 | | 5/2001 |
| JP | 2002065752 | | 3/2002 |
| JP | 2002096668 | | 4/2002 |
| JP | 2003210271 | | 7/2003 |
| JP | 3165162 | U | 12/2010 |
| JP | 2011167532 | A | 1/2011 |
| JP | 2012020124 | A | 2/2012 |
| JP | 2014004324 | | 1/2014 |
| KR | 2000642240000 | | 12/1991 |
| KR | 2003014440000 | | 1/2003 |
| KR | 2003295050000 | | 10/2003 |
| KR | 1020060051337 | | 5/2006 |
| KR | 1014130450000 | | 2/2014 |
| WO | 9416600 | A | 8/1994 |
| WO | 2012011111 | A1 | 1/2012 |

OTHER PUBLICATIONS

Fuze T20; PDG Product Design Group; http://www.pdgmobility.com/products/fuze-T20/index.html.
Solara jr. Brochure, 2001.
Fuze T50; PDG Product Design Group; http://www.pdgmobility.com/products/fuze-T50/index.html.
Grand Fletcher; Miki Mobility; www.miki-mobility.com.
Zippie TS; Sunrise Medical; http://www.sunrisemedical.com/Products/zippie/Manual/Zippie%C2%AE-TS.aspx.
Solara; Invacare; http://www.rubrication.net/images/PDF-Preview-Invacare-Solara-Wheelchair-for-Invacare-Wheelchair-Solara-Mobility-Aid. png.
Freedom CGX; Freedom Designs; http://www.freedomdesigns.com/WC%/20CGX.html.
VIP 515; Karma Medical; http://www.karmamedical.com/goods_view.php?no=19.
Solara 3G; Invacare; http://www.invacare.com/cgi-bin/imhqprd/inv_catalog/prod_cat_detail.jsp?s=0&prodID=SOLARA3G&catOID=null.
Solara 2G; Invacare; http://www.chairequip.net/invacare-solara-2g-detail.htm?productid=3305206.
Wheeler; Invacare (Europe); https://ytu4dq.by3301.livefilestore.com/y2mpaBJZxer8m7ImpbBzAReJska1BJWW80iR1-p_IGBAc1bhvJ6QqzB8alOkjtEmHSgjR-DLkAGD0qx9Gi6sjFn8gkSgx53gJ1dZVIY730B08A7b_zWRYNbuv5NnuUxdzkr/Wheeler2.jpg.
HW1 Spring; Heartway USA; http://www.heartwayusa.com/products/manual-wheelchair/spring-hw1.
Canto Nxt; Life & Mobility B.V.; http://www.life-mobility.com/Engels/Products/Wheelchairs/Wheelchairs/Productdetail/Canto%20Nxt/page.aspx/182?productid=180.
Stellar; PDG Product Design Group; http://www.pdgmobility.com/products/stellar/index.html.
Optimo Tilt; Remploy Wheelchairs UK; http://www.jacksonsleisure.co.uk/disability-aids/wheelchairs/self-propelled_wheelchairs.htm.
IBIS; Handicare; http://www.handicare.ca/1/Products/Manuele-rolstoelen/IBIS/.
Kidster; Gunnell Inc.; http://gunnell-inc.com/store.php?crn=201.
Rehab TNT; Gunnell Inc.; http://gunnell-inc.com/store.php?crn=199.
Fuze Jr.T50; PDG Product Design Group; http://www.pdgmobility.com/products/fuze-T50Jr/index.html.
Solara_and_Solara_Limited_Service_Manual; 2004; Invacare.
Solara_Jr_Operator_and_Maintenance_Manual; 2002; Invacare.

* cited by examiner

TILT-IN-SPACE WHEELCHAIR USING MULTIPLE CONTROLLING PATHS

CROSS-REFERENCE TO RELATED APPLICATIONS

This application claims the benefit of U.S. Provisional Patent Application Ser. No. 61/772,386 for a TILT-IN-SPACE WHEELCHAIR USING MULTIPLE CONTROLLING PATHS, filed on Mar. 4, 2013, which is hereby incorporated by reference in its entirety.

BACKGROUND OF THE INVENTION

1. Field of the Invention

The present invention relates to a tiltable or tilt-in-space wheelchair.

2. Description of Related Prior Art

Various forms of tilt-in-space wheelchairs are known in which a seat frame is tiltable relative to a wheeled base frame for various known benefits including providing weight shift and pressure redistribution, repositioning for comfort and pain relief, and providing postural stability.

Some examples of tilt in space wheelchairs can be found in U.S. Pat. Nos. 6,206,393 and 6,126,186 by Mascari et al; U.S. Pat. No. 7,007,965 by Bernatsky et al; U.S. Pat. No. 7,185,910 by Beauchesne et al; and U.S. Pat. No. 7,090,240 by Papac. Other prior art relating generally to tilting seats can be found in U.S. Pat. No. 2,195,428 by Searing; U.S. Pat. No. 4,515,337 by Torras; U.S. Pat. No. 7,850,238 by Erb et al; and U.S. Pat. No. 4,192,549 by Petersen.

The state of the art in the tilt chair industry is to provide wheelchair seating systems on bases that use arcuate tracks that have a substantially constant-radius arc with a focal point adapted to be substantially coincident with the center of gravity of the user. This alignment creates an easy rotation of the supported weight as the CG of the system is not being actively lifted or lowered in the act of tilt.

A potential issue with this approach is the need for set-up of the user and the seating system center of gravity to be closely aligned. Lack of a reliable feedback method to actively manage the set-up and mistakes in set-up can lead to misalignment where-by the seating system is not always stable in the supporting track system. The seating system and user weight can act like an "inverted pendulum" and the supported weight creates a force that actively rotates the system in the supporting tracks, with the potential of the system slamming in either a forward or upright position. In practice this can create a rather unsafe event for the user and for the care-giver.

SUMMARY OF THE INVENTION

In summary, the invention is a wheelchair. The wheelchair includes a base frame extending in a fore-aft direction and a lateral direction perpendicular to the fore-aft direction. The wheelchair also includes a plurality of wheels supporting the base frame for movement. The wheelchair also includes a seat frame operable to support a seat and a wheelchair occupant sitting in the seat. The wheelchair also includes a support assembly interconnecting the seat frame to the base frame for pivoting movement between an upright position, a fully-tilted position and an intermediate position between the upright position and the fully-tilted position. The support assembly utilizes a plurality of control paths to direct the seat frame in translating and rotating planar body motion that defines a fixed centrode. A center of gravity of the seat frame and the seat and the wheelchair occupant is definable in operation. In one aspect of the present disclosure, the plurality of control paths are arranged such that the center of gravity is directable during pivoting movement of the seat frame along a follower path being at least one of substantially horizontal and concave with the center of gravity vertically lower in the intermediate position than in at least one of the upright position and the fully-tilted position. In another aspect of the of the disclosure, the seat frame is adjustably positionable relative to the base frame in the fore-aft direction such that the position of the center of gravity is settable through adjust along a single axis to create an alignment of the center of gravity with the fixed centrode and thereby creates stability within the limits of the range of motion of the system.

BRIEF DESCRIPTION OF THE DRAWINGS

The detailed description set forth below references the following drawings.

DETAILED DESCRIPTION OF EXEMPLARY EMBODIMENTS

Figure 1:
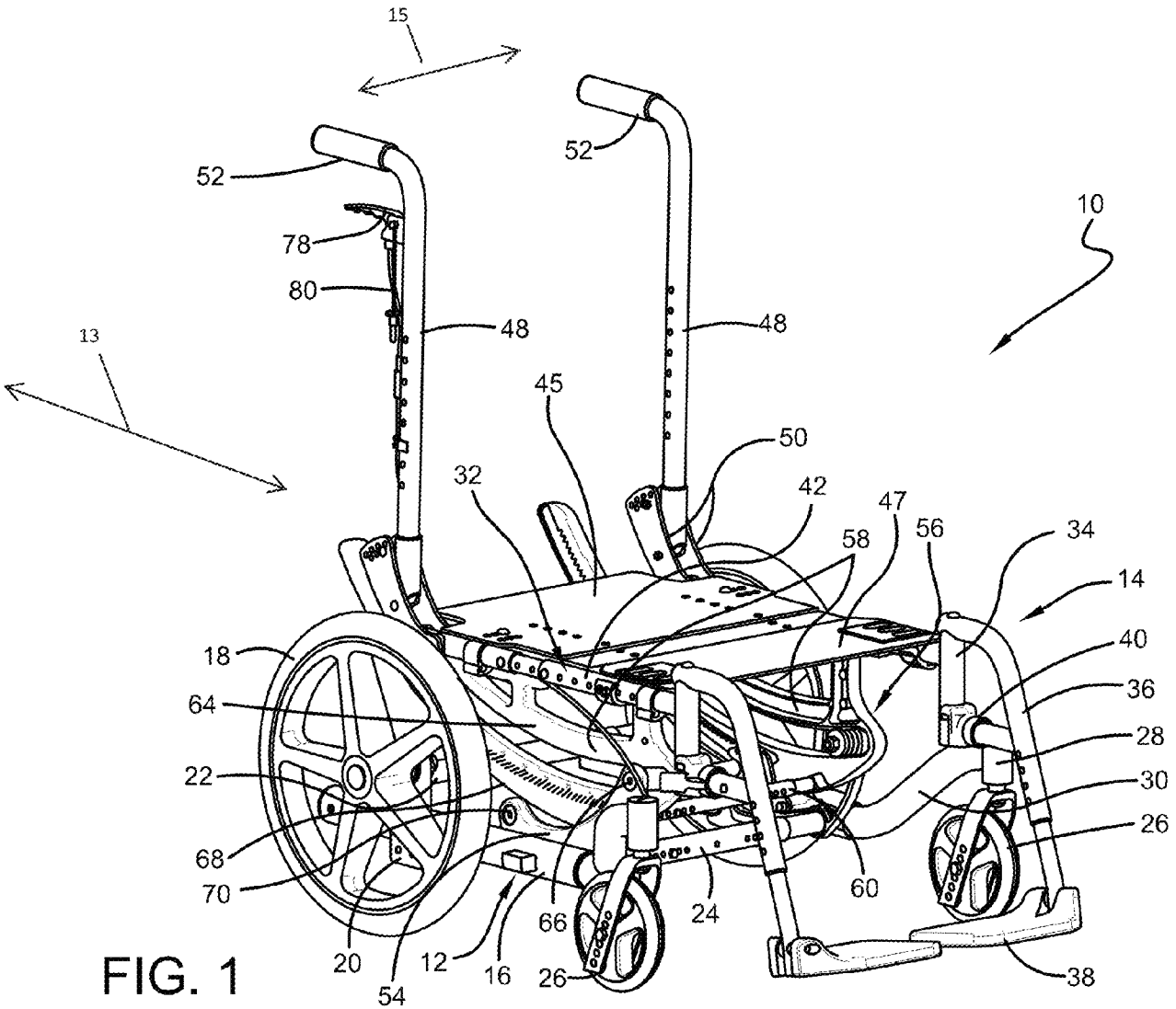
FIG. 1 is a perspective view of the wheelchair.
Figure 2:
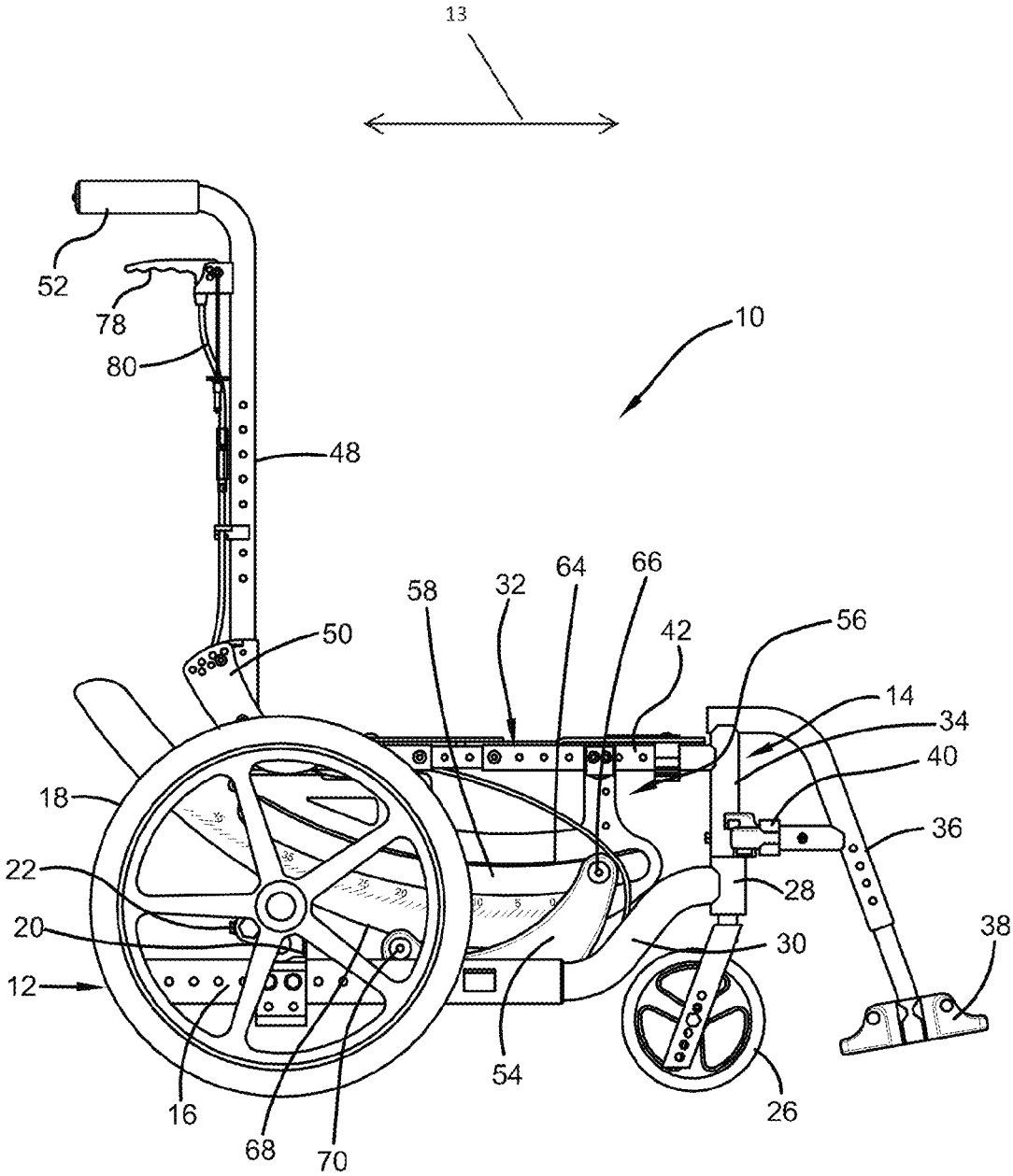
FIG. 2 is a side elevational view of the wheelchair of FIG. 1 in the upright position.
Figure 3:
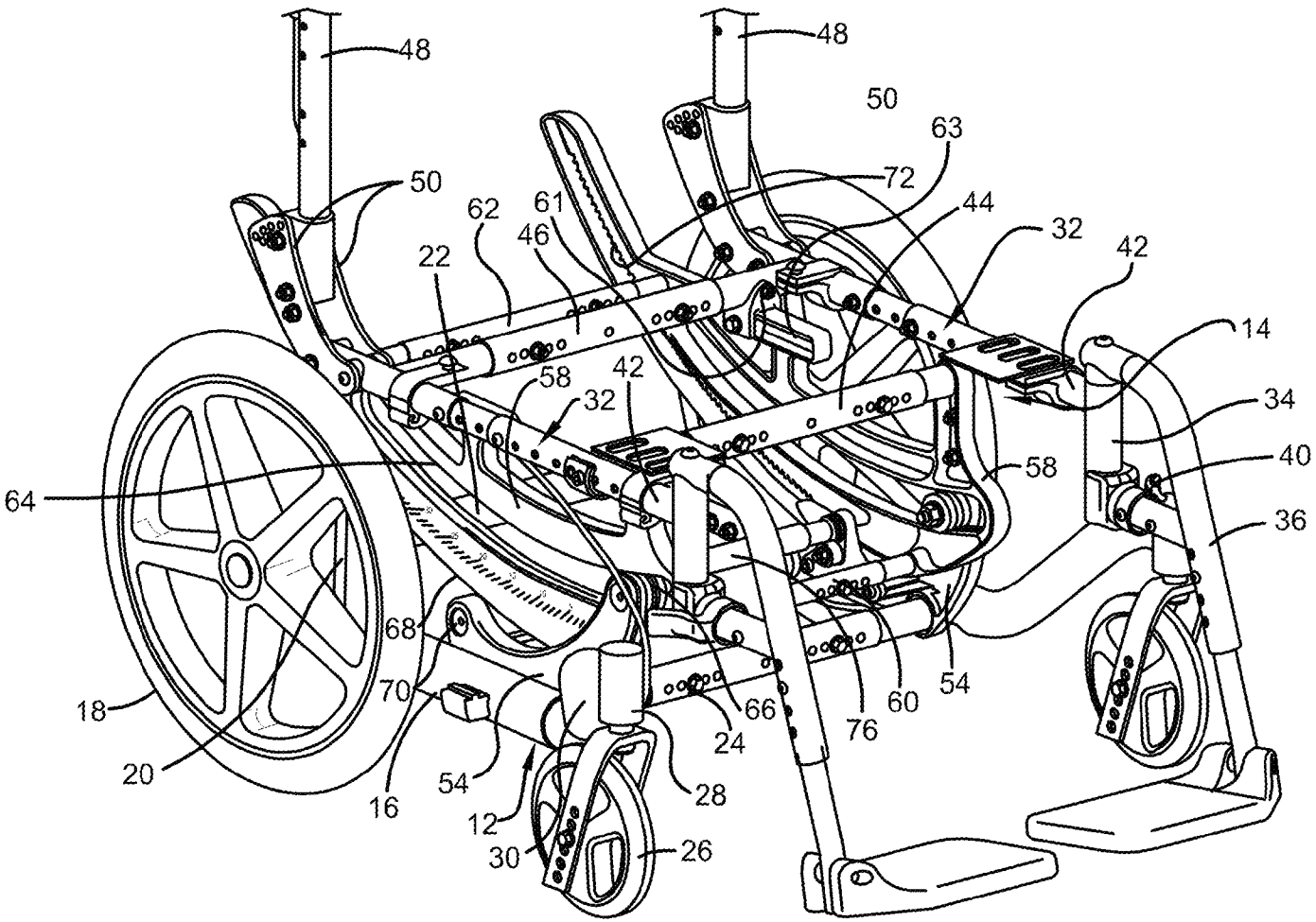
FIG. 3 is a front, top perspective view of the seat frame and base frame of the wheelchair of FIG. 1.
Figure 4:
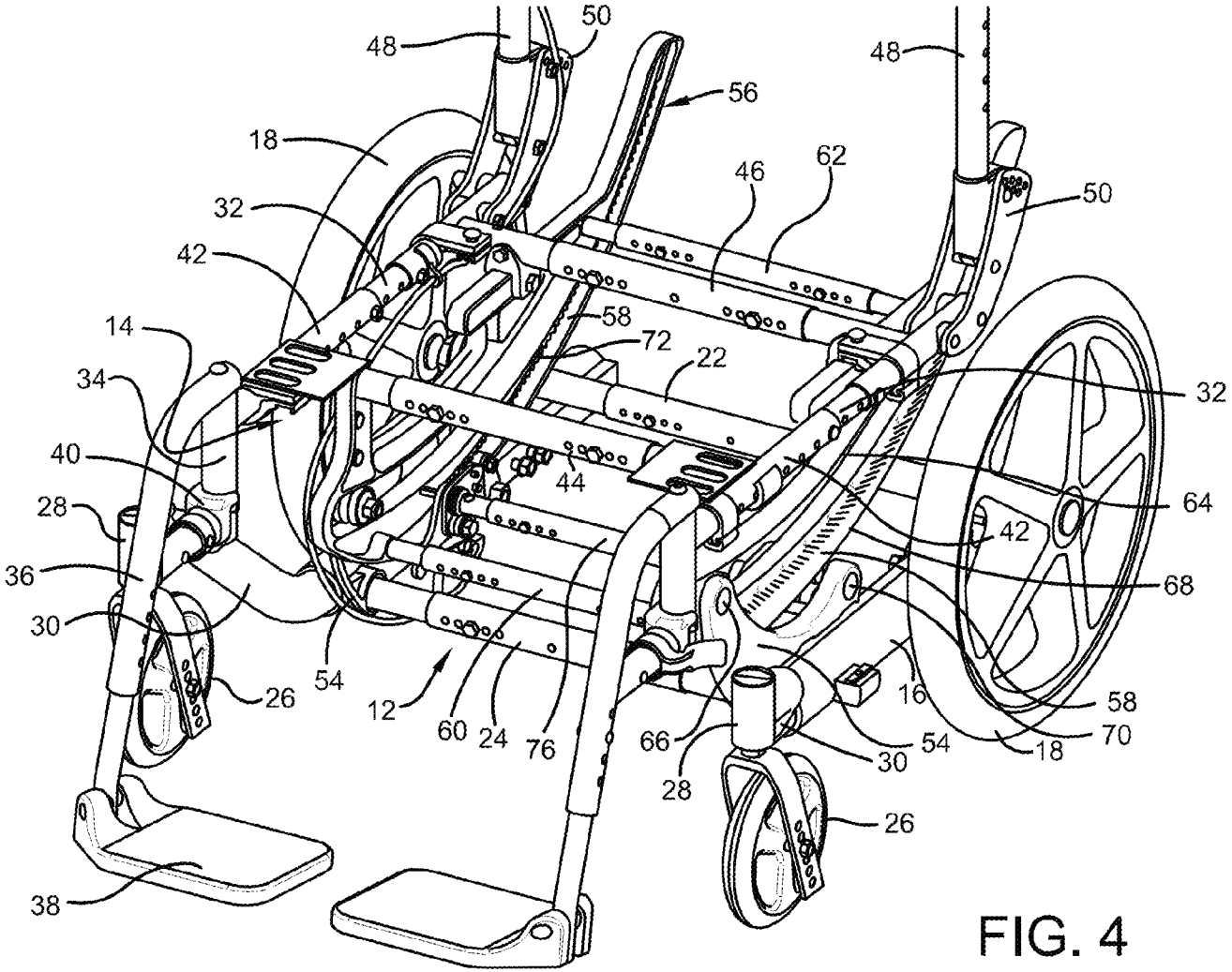
FIG. 4 is another front, top perspective view of the seat frame and base frame of the wheelchair of FIG. 1.
Figure 5:
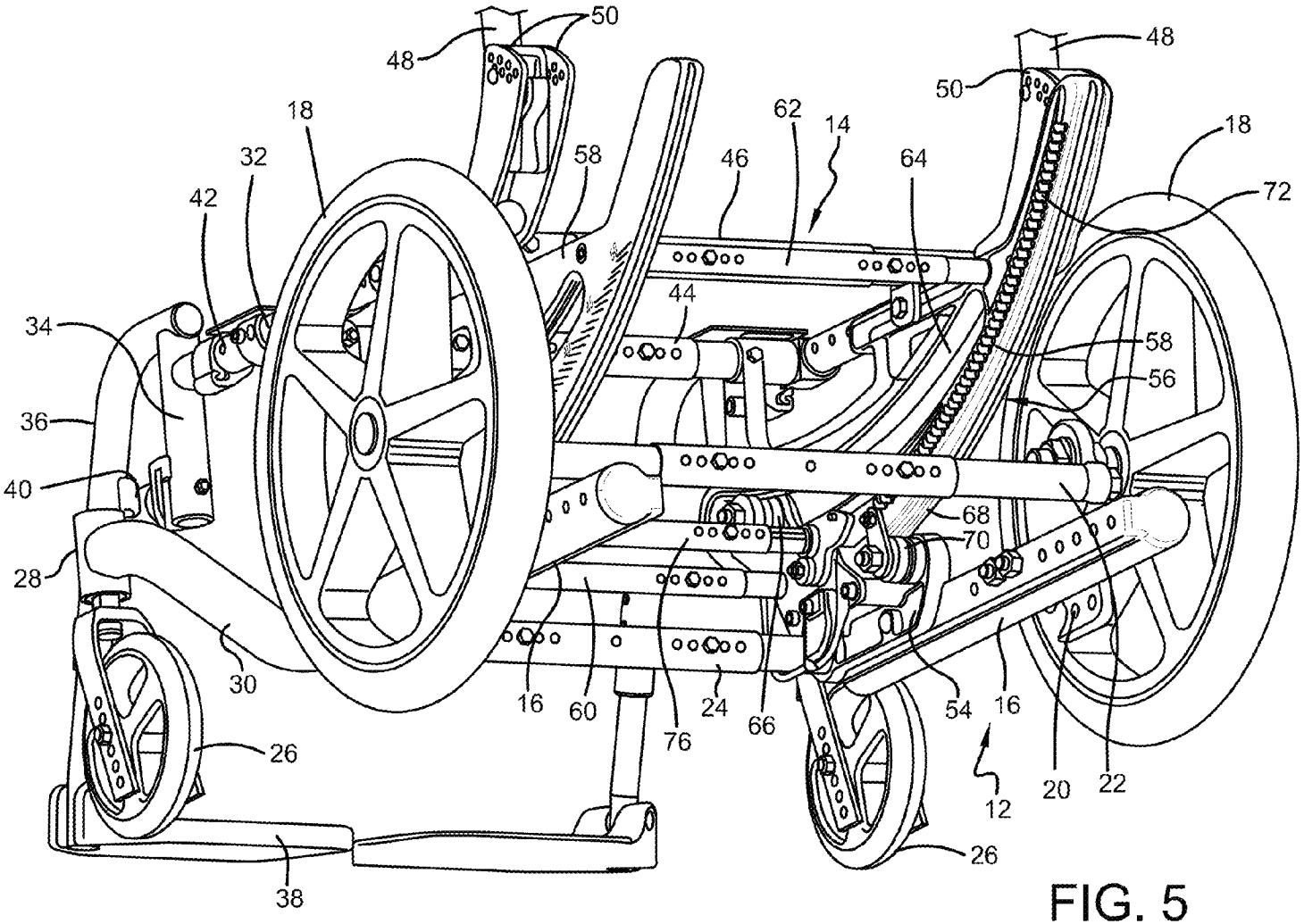
FIG. 5 is a bottom, rear perspective view of the seat frame and base frame of the wheelchair of FIG. 1.
Figure 6:
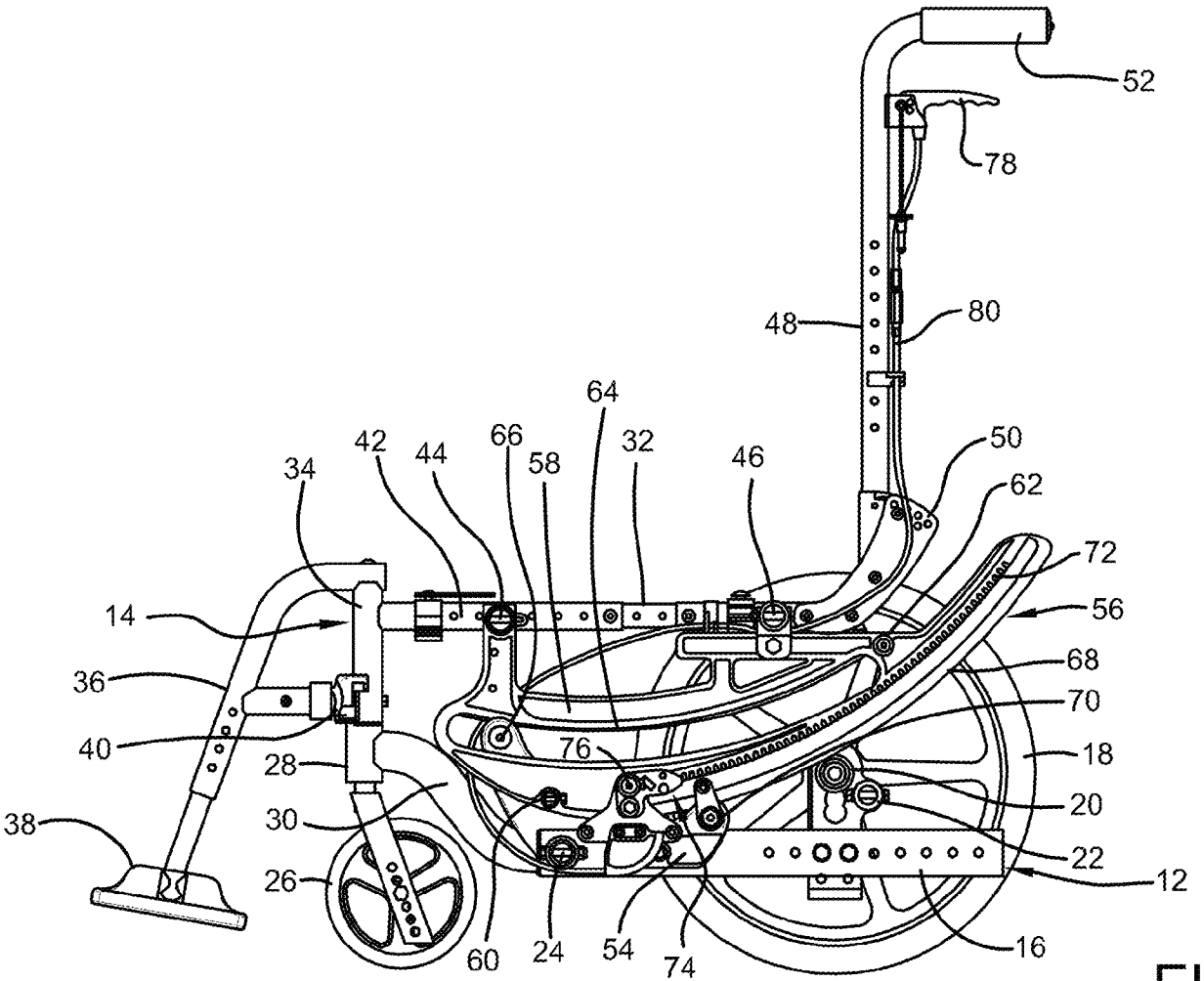
FIG. 6 is a sectional elevational view of the wheelchair of FIG. 1.

The present invention provides a support assembly which is able to both minimize the lift or lowering of the supported weight while eliminating the potential for the center of gravity (CG) to be accelerated to either tilted or fully-upright limits of the system. A method of "feedback" in the system set-up would also aid in the alignment of the user in the wheelchair. This approach to "safe-tilt" can be executed by using multiple controlling paths for the support of the seating system. More than one defined spline or arcuate controlling path can be utilized to create a resultant controlled path followed by the seat frame relative to the base frame of the wheelchair where-by the center of curvature of the defined pathways are always well above the zone in which the system center of gravity falls on the wheelchair and creates a fixed centrode defined by the instantaneous centers of rotation that control the CG motion to ensure that there is never an instance of the weight acting like an inverted pendulum. The defined paths can also minimize the amount of translation of the tilted system center of gravity to reduce the force needed to lift or lower the weight as the system is tilted.

To manage the center of gravity translation and thus minimize the force needed to rotate the system there is an effective zone in which the relationship of the CG to the fixed centrode is maintained. The seating system and user weight is shifted to align the CG with the position defined by the fixed centrode that is dynamically stable, where the CG is at its lowest position along its path. During tilting, from this stable intermediate position between the fully-upright and fully-tilted limits, the CG of the system requires force to be moved and the system wants to naturally translate to the stable position without outside forces applied. In our system the preferred position for this is at a tilt of 20 degrees and becomes a feedback control for set-up that insures the CG to center of curvature alignment is effective for safety and ease of rotation.

The seating system is developed to provide translation of the seat both horizontally and vertically and independent positioning of the footrest and backrest to effectively position the CG of the user in the effective range.

The current design is executed showing two control paths incorporated as tracks on a plate, or "rocker". The rollers that support the pathways reduce the friction in the system and allow for only rolling contact as seen in our images.

One illustrated embodiment provides only horizontal positioning of the seating system relative to the rocker, but another illustration of an alternative embodiment is provided to show the potential for vertical adjustment as well.

Further to the concept, but not shown in the illustrated embodiment is the capability of a user being able to self-tilt by having a feature in which they can apply the external force of rotation and for the addition of a motor that could effectively apply the force of rotation for a powered tilt.

Referring to the accompanying figures, there is illustrated a wheelchair generally indicated by reference numeral 10. The wheelchair 10 is suited for supporting a user seating thereon such that the seating surfaces and the user seated thereon are tiltable through a range of inclinations to provide various known benefits. In particular, the tilting provides weight shift and pressure redistribution to vary the seating surfaces upon which the user is supported and to redistribute pressure away from critical areas. The tilting can also be useful for supporting different postures.

The wheelchair 10 generally comprises a base frame 12 supported for rolling movement along the ground and a seat frame 14 which is arranged to support a user seated thereon. The wheelchair 10 includes a base frame 12 extending in a fore-aft direction and a lateral direction perpendicular to the fore-aft direction. The fore-aft direction is referenced by axis 13 and the lateral direction is referenced by axis 15. A support assembly is provided which supports the seat frame 14 on the base frame 12 such that the seat frame 14 is movable relative to the base frame 12 along a controlled path from a upright position, through an intermediate position to a fully-tilted position. Typically, the upright position corresponds to the seat surface upon which the user is seated being generally horizontal or near 0 degrees from horizontal. Displacement towards the fully-tilted position involves displacing the leg assemblies supporting the legs of the user and the seat frame 14 until the seating surface of the seat frame 14 can be oriented as much as 45 or 50 degrees from horizontal for example in the fully-tilted position. Accordingly, in the fully-tilted position the seating surface extends upwardly and forwardly from a rear end to a forward end thereof. The support assembly is preferably gravity biased from either one of the upright or fully-tilted positions to the intermediate position which may correspond to the seating surface being oriented at 20 degrees from horizontal for example.

The base frame 12 generally comprises two side frame members 16 which are generally parallel and spaced apart from one another to extend in the forward direction of the wheelchair 10 from respective rear ends to respective front ends thereof.

Two rear wheel assemblies are arranged to be mounted onto the two side frame members 16 respectively adjacent rear ends thereof. The rear wheel assemblies each comprise a large diameter rear wheel 18 fixed for rolling movement in the forward direction of the wheelchair 10, and an axle mount 20 which mounts the respective rear wheel 18 onto the side frame member 16 such that the wheel is height adjustable relative to the side frame member 16. The axle mounts 20 are also arranged to be mounted at any one of a plurality of longitudinally spaced positions along the side frame members 16. In further embodiments, the axle mounts 20 may also provide for camber adjustment of the rear wheels.

A rear crossbar 22 is coupled between the axle mounts 20 of the two rear wheel assemblies so as to be generally fixed between the rear ends of the two side frame members 16 of the base frame 12.

A front crossbar 24 is also coupled between the two side frame members 16 adjacent the front ends thereof. Both the front and rear crossbars comprise telescoping members with cooperating apertures formed therein to permit fasteners to secure the crossbars at a plurality of different widths corresponding to different lateral spacings between the two side frame members 16.

Each side frame member 16 also includes a plurality of mounting apertures formed therein at an intermediate location between the front and rear ends to permit mounting of various components of a support assembly (to be described in greater detail below) for longitudinal adjustment along the respective side frame members 16 as described in further detail below.

The base frame 12 also includes two front wheel assemblies mounted on the front ends of the two side frame members 16 respectively. Each front wheel assembly comprises a front castor wheel 26 coupled to a vertical pivot assembly 28 which is in turn mounted to the respective side frame member 16 by a mounting arm 30. The vertical pivot permits each front castor wheel 26 to be pivotal about a vertical castor axis relative to the mounting arm 30 and the base frame 12 to which it is coupled. Each mounting arm 30 includes an elongate tubular mounting portion which is slidably received into an open end of a tubular member forming the respective side frame member 16 such that the front wheel assembly is slidably adjustable relative to the respective side frame member 16 in the longitudinal direction of the side frame member 16 corresponding to the forward direction of the wheelchair 10. The front castor wheels 26 are thus adjustable in the forward direction relative to the side frame members 16 and relative to the components of the support assembly and the rear wheel assemblies mounted thereon.

The seat frame 14 also includes two side frame members 32 which are parallel and laterally spaced apart from one another to similarly extend in the forward direction of the wheelchair 10 from respective rear ends to respective front ends thereof. A vertical pivot mount 34 is mounted at the front end of each side frame member 32 for supporting a respective leg support assembly thereon for pivotal movement about a respective vertical axis between a forward working position and a laterally stored position.

Each leg support assembly comprises a leg member 36 extending downwardly and forwardly from the pivot mount 44 for supporting a foot support plate 38 at the bottom end thereof. The foot plate extends generally horizontally inwardly towards the other foot plate in the working position but can be folded upwardly along the inner side of the leg member 36 in a manner similar to conventional wheelchairs. In the working position the leg members 36 each extend forwardly from the seat frame 14 and are retained in the working position by respective latches 40. Releasing the latches 40 permit the leg assemblies to be pivoted about respective vertical axes to extend generally laterally outwardly away from one another.

The longitudinal position of the leg assemblies relative to the seat frame 14 can be adjusted by permitting a forward portion 42 of each side frame member 32 to be telescopically extended relative to intermediate and rearward portions of the side frame member 32 to adjust the overall length thereof in the longitudinal direction. In further instances, the forward portions 42 can be interchanged with different forward portions of similar configuration but which are longer in the forward direction to mount the vertical pivot mounts 34 and the leg assemblies supported thereon even further forward from the rear ends of the side frame members 32 of the seat frame 14 if desired.

Each seat frame 14 further comprises a front crossbar extending in the lateral direction between opposing ends coupled to the two side frame members 32 respectively. Longitudinally spaced mounting apertures are provided in the forward portion 42 of each side frame member 32 such that the front cross bar 44 can be mounted at a plurality of longitudinally spaced positions in the forward direction relative to the rear ends of the side frame members 32 of the seat frame 14. Telescoping adjustment of the forward portion 42 of the side frame members 32 mounting the front crossbar thereon relative to the rear ends of the side frame members 32 also permits longitudinal adjustment of the front crossbar relative to the rear ends of the side frame members 32.

The seat frame 14 further comprises a rear crossbar 46 which is mounted between the rear ends of the two side frame members 32 of the seat frame 14. Both of the front and rear crossbars also comprise telescoping members which are adjustable in length for adjusting the overall width of the seat frame 14 to correspond with a selected width of the base frame 12.

The front and rear crossbars 44, 46 and the two front portions 42 of the seat frame members 32 of the seat frame 14 all lie in a generally common plane which is substantially horizontal in the upright position. Support plates, such as plates 45, 47, are mounted onto the seat frame 14 to lie the in common plane of the seat frame members 32 so as to permit mounting of a suitable seat supporting surface thereon such as a seat cushion of various configurations.

The seat frame 14 further includes a back support which is supported by two upright posts 48. Each post 48 is pivotally mounted at a bottom end thereof to the rear end of a corresponding one of the side frame members 32. Each post 48 is pivotally supported by a respective pair of parallel plates 50 fastened to the rear ends of the side frame members 32 and pivotally supporting the bottom end of the respective post 48 therebetween. Fasteners which extend between the parallel plates 50 through the posts 48 define respective horizontal pivot axes such that the two posts 48 are commonly pivoted about a common horizontal axis spanning between the rear ends of the two side frame members 32.

A plurality of cooperating apertures permits the two posts 48 to be secured at a plurality of different angular orientations relative to the common plane of the side frame members 32. In the illustrated embodiment, the two posts 48 are initially oriented at approximately 90 degrees to the common plane of the seating surface but are permitted to be adjusted through a range of angles greater than 90 degrees to provide an inclined back supporting surface as desired. Various rear cushions can be coupled between the two posts 48 to define an upright back support surface which is adjustable in inclination relative to the seat surface.

The two posts 48 also define a pair of handles 52 at the top ends thereof which extend generally rearward for ease of gripping by a person standing rearward of the wheelchair 10.

The support assembly is generally comprised of a first controlling assembly defining a first controlling path and a second controlling assembly which defines a second controlling path different from the first controlling path. The seat frame 14 thus follows a resulting, cumulative or blended controlled path relative to the base frame 12 as the seat frame 14 follows both first and second controlling paths between the upright position and the fully-tilted position. The controlled path involves movement of the seat frame 14 between the upright and fully-tilted positions, a controlled variation of the angular orientation of the seat frame 14 relative to horizontal.

The support assembly includes control mounts 54 fixed on the base frame 12 for connecting respective components of the first and second controlling assemblies to the base frame 12. The support assembly further includes a control frame 56 which is fixed to the seat frame 14 for supporting respective components of the seat frame 14.

The control frame 56 generally comprises two control bodies 58 which are generally upright and planar in configuration so as to be parallel and spaced apart at opposing sides of the wheelchair 10 while being oriented generally in the forward direction of the wheelchair 10. Each control body 58 is mounted to and below a respective one of the side frame members 32 of the seat frame 14.

The control frame further includes a front crossbar 60 connected between the control bodies 58 adjacent the forward end thereof and a rear crossbar 62 fixed between the two control bodies 58 adjacent the rear ends thereof. Each of the front and rear crossbars 60, 62 are generally horizontal and perpendicular to the forward direction. The front and rear crossbars 60, 62 further comprise telescoping members formed of plural sections with cooperating apertures therein so as to be adjustable in length for adjusting to various widths of the wheelchair 10 similarly to the other crossbars noted above.

The two control bodies 58 are mounted in fixed relation to the seat frame 14 by mounting a front end of each control body 58 onto the front crossbar 44 of the seat frame 14 adjacent the two side frame members 32 respectively. The control bodies 58 are mounted to the front crossbar 44 so as to be adjustable together with the front crossbar 44 relative to the rear ends of the side frame members 32 of the seat frame 14.

The control bodies 58 are also coupled to the rear crossbar 46 at opposing ends thereof adjacent the two side frame members 32 respectively. The control bodies 58 are formed so as to be mounted at a plurality of longitudinally spaced positions in the forward direction of the wheelchair 10 relative to the rear crossbar 46 as the front ends of the control bodies 58 are moveable with the front cross bar 44 when adjusting the length in the forward direction of the seat frame 14. A bracket 61 can slide within a slot 63 formed in the control body 58 for adjustment and then tightened when a desired position is obtained.

The first control assembly includes two first arcuate tracks 64 formed in the two control bodies 58 respectively to commonly define the first controlling path of the support assembly. The tracks generally take the form of an arcuate slot formed at an intermediate location within the control bodies 58 respectively. The first control assembly further includes a pair of first followers 66 mounted on the control mounts 54 on opposing ones of the side frame members 16 of the base frame 12. The followers 66 each comprise rollers which are fitted within the slots defining the first arcuate tracks 64 for rolling movement therealong between the upright and fully-tilted positions of the seat frame 14 relative to the base frame 12. The rollers defining the first followers 66 are oriented for rotation about a common horizontal axis perpendicular to the forward direction. It is noted that followers 66 act as cams and first arcuate tracks 64 act as cam followers.

Similarly the second control assembly comprises two second arcuate tracks 68 defined by the bottom edges of the respective control bodies 58 in which the second tracks commonly define the second controlling path of the second support assembly. The second control assembly accordingly further comprises two second followers 70 mounted on the control mounts 54 on opposing ones of the two side frame members 16 of the base frame 12 respectively. The second followers 70 similarly comprise rollers oriented for rotation about a common horizontal axis oriented perpendicularly to the forward direction at a location which is spaced downwardly and rearwardly in relation to the common axis of the first followers 66. The second followers 70 are arranged for rolling engagement along the respective second tracks 68 between the fully-tilted and upright positions of the seat frame 14 relative to the base frame 12. It is noted that followers 70 act as cams and first arcuate tracks 68 act as cam followers.

In this manner, the seat frame 14 moves between the fully-tilted and upright positions guided by the first followers 66 guiding and urging the first arcuate tracks 64 which define the first controlling path and the second followers 70 guiding and urging the second tracks 68 which define the second controlling path. The resulting movement of the seat frame 14 along a composite or blended controlled path involves some relative movement between the followers 66, 70 along the tracks 64, 68 as well as a change in angular orientation of the seat frame 14.

The exemplary first and second arcuate tracks 64, 68 and the controlling paths which are defined by the tracks 64, 68 each comprise a constant radius arc in which a center curvature of the arc is maintained generally above the center of gravity of the system. The system includes all structures tilted or pivoted with the seat frame 14. When the wheelchair 10 is in operation, the system includes the seat frame 14, the user, the seat the user is sitting upon, and any other structure moving with the user. The exemplary controlling paths are arranged such that at an intermediate position, the centers of curvature are near in elevation to one another with one center of curvature being spaced forward of the other. Generally at the intermediate position, one of the centers of curvature of the tracks 64, 68 is forward of the center of gravity of the system while the other center of curvature is rearward of the center of gravity of the system.

Generally, the center of gravity of the system, with a user seated in a seat mounted on the seat frame 14, is established at an initial set-up of the wheelchair 10 and is customized to the particular comfort preferences of the user of the wheelchair 10. The center of gravity is generally established after adjustments to the positioning and lengths of various structures of the seat frame 14, such as adjusting the fore-aft length and lateral width of the seat frame 14, and adjusting the longitudinal position of the connection of the control frame 56 to the seat frame 14. Generally, the center of gravity can be established so that the center of gravity of the system is arranged to be below both centers of curvature of the two tracks 64, 68 throughout the full range of tilting movement of the seat frame 14 relative to the base frame 12.

Generally the positions of the arcuate tracks 64, 68 can be arranged such that the wheelchair 10 follows a resulting control path in which the center of gravity of the system remains substantially fixed in the fore-aft direction of the wheelchair 10 as the seat frame 14 is displaced from the upright to the fully-tilted position. The center of gravity however can rise as the seat frame 14 is displaced from the intermediate position towards either one of the fully-tilted position or the upright position. More particularly, the tracks 64, 68 can be arranged and configured such that the center of gravity rises relative to the center of curvature or instantaneous center of the composite or blended control path when the seat frame 14 is pivoted from the intermediate position towards either one of the front or rear positions.

As the seat frame 14 is displaced towards the fully-tilted position, the center of curvature or instantaneous center of both controlling paths are arranged to be both positioned ahead of the center gravity of the system; as a result, the system is gravity-biased back to the intermediate position. Similarly in the upright position, the center of curvature or instantaneous center of both controlling paths are arranged to be rearward of the center of gravity of the system; as a result, the system is gravity-biased back to the intermediate position.

Once in the desired position, the seat frame 14 is typically latched in the desired position by a suitable latching assembly. In the illustrated embodiment, the latching assembly comprises a rack 72 provided on each control body 58 in proximity to the second tracks 68. Each rack 72 comprises longitudinally spaced notches for selective locking engagement with a respective latch pin 74 supported on the control mounts 54 of the base frame 12 respectively.

Figure 7:
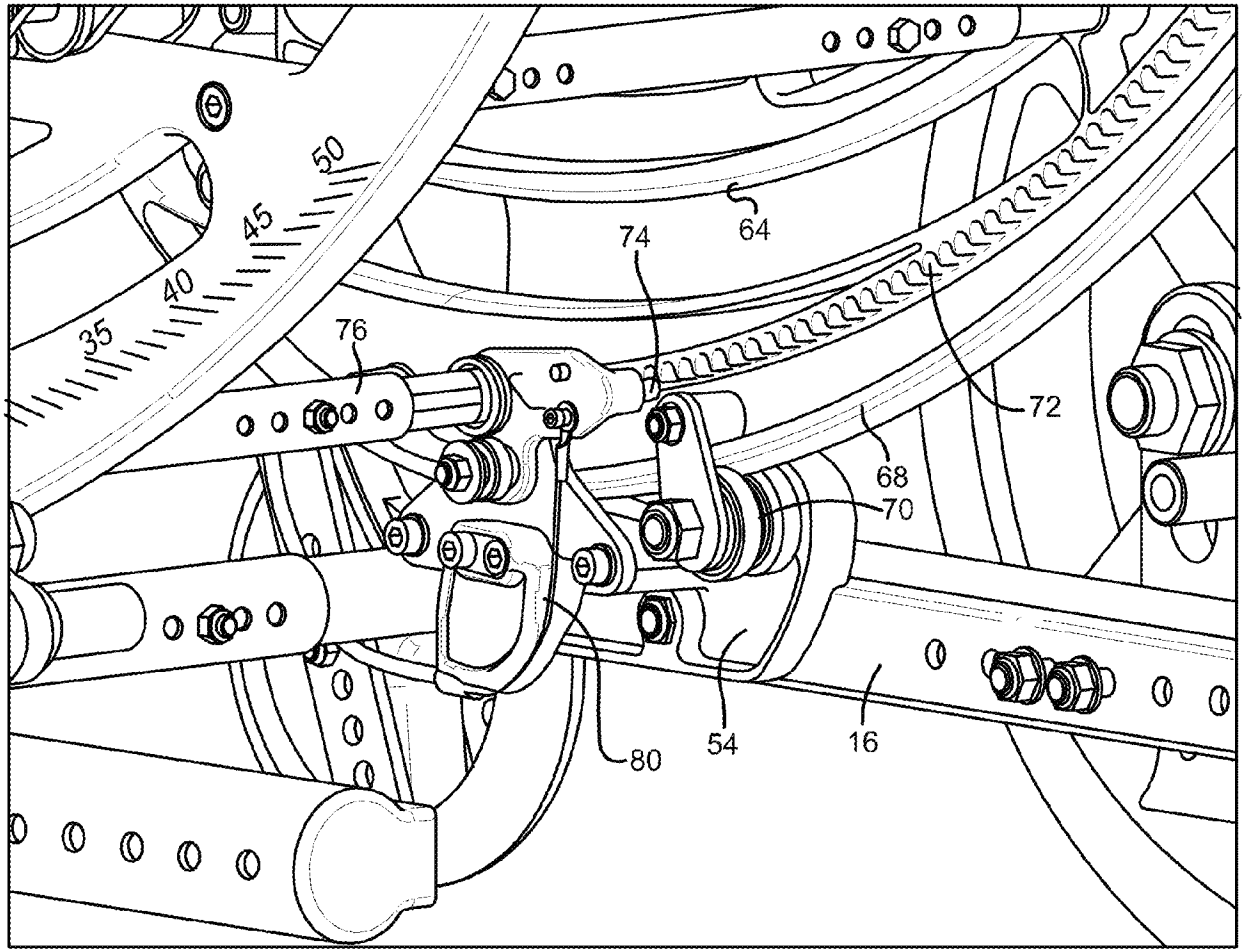
FIG. 7 is a perspective view of the latching assembly of the wheelchair of FIG. 1.
Figure 8:
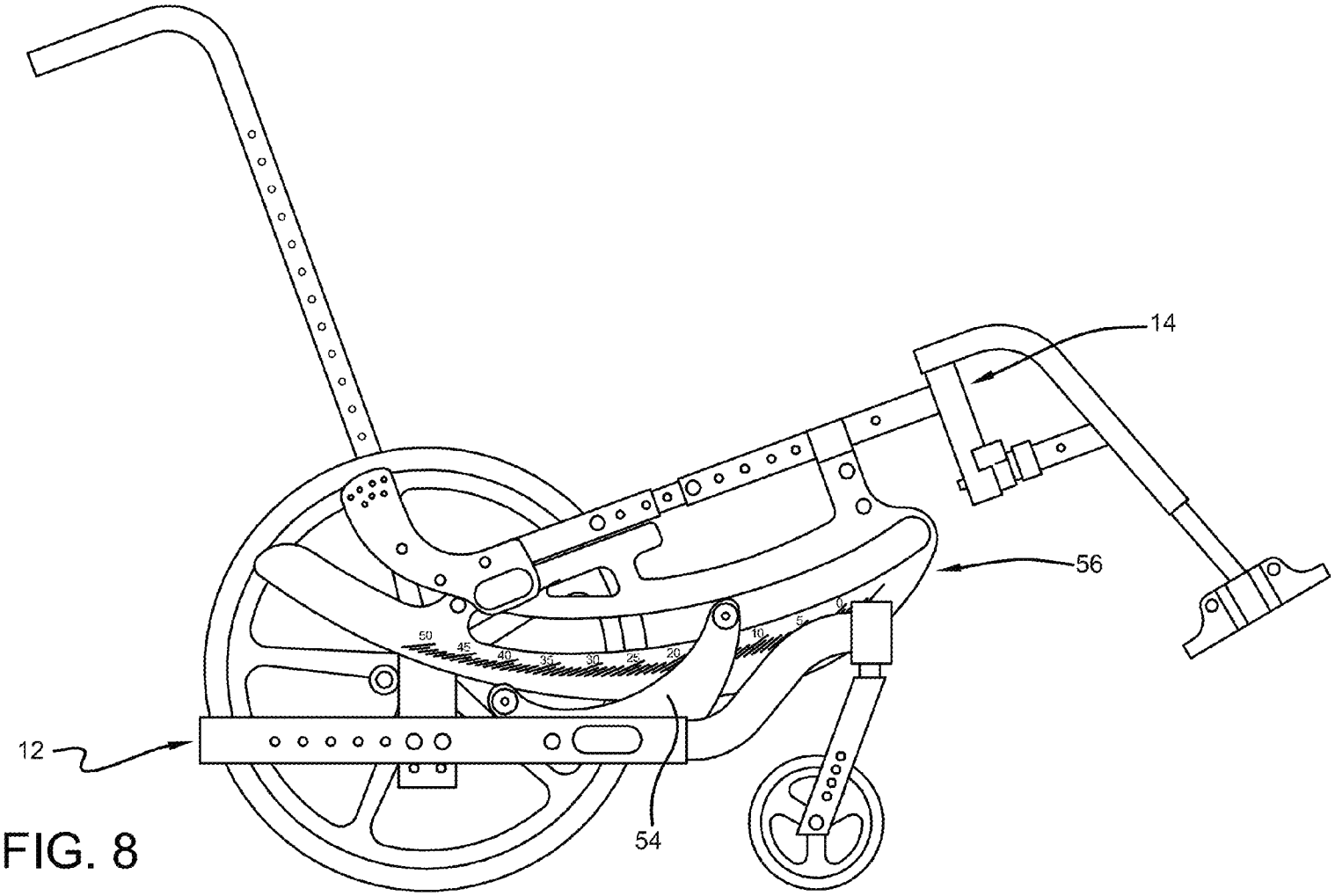
FIG. 8 is a side elevational view of the wheelchair of FIG. 1 in the intermediate position.
Figure 9:
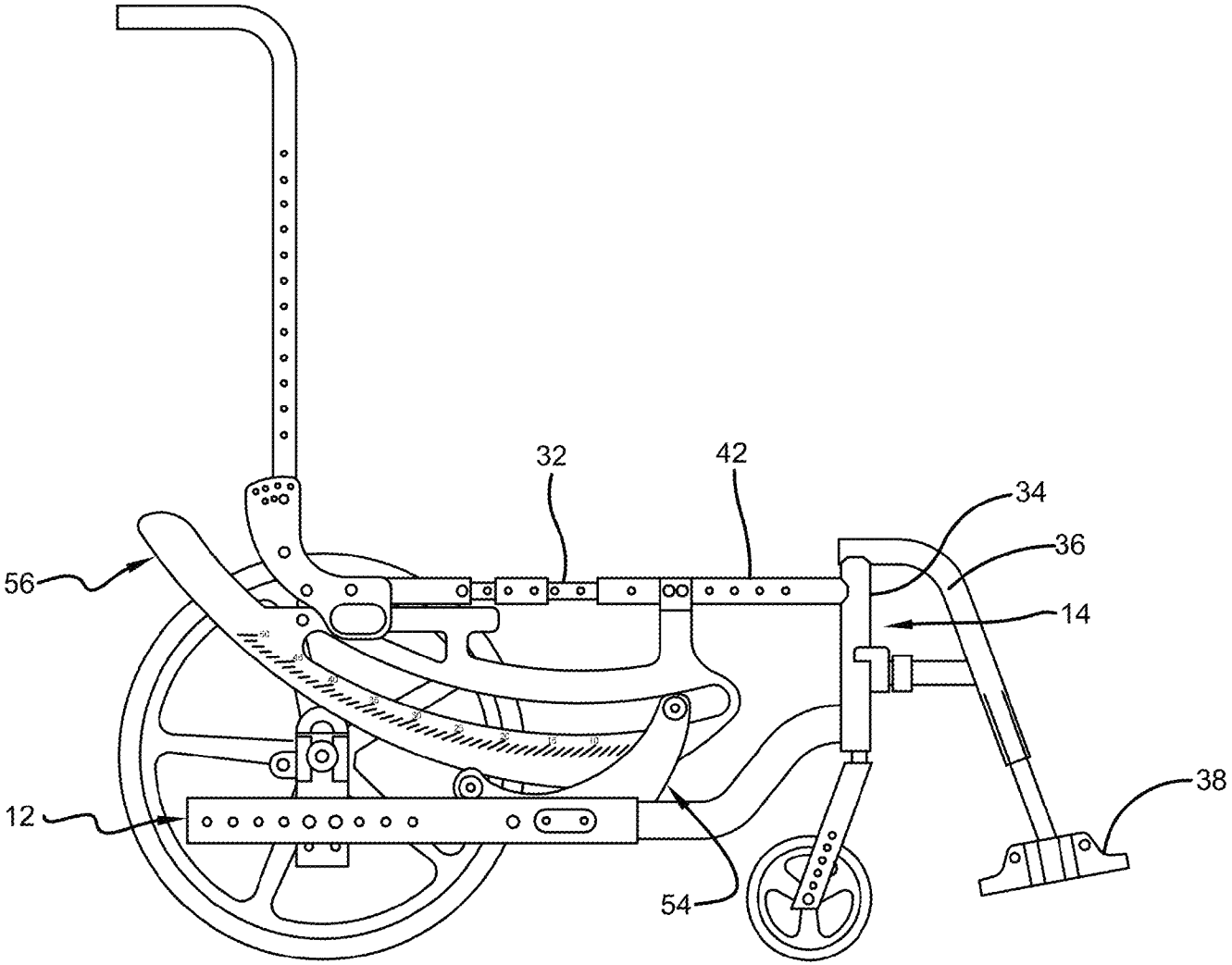
FIG. 9 is a side elevational view of the wheelchair of FIG. 1 in an extended position of the seat frame and the base frame in the upright position.

Each latch pin 74, as best seen in FIG. 7, is moveable from a disengaged position from the rack 72 to permit free movement of the seat frame 14 relative to the base frame 12, and an engaged position in which the two latch pins 74 are engaged within corresponding notches of the two racks 72 to fix the position of the seat frame 14 relative to the base frame 12. The latch pins 74 can be biased to the engaged position.

A common shaft 76 is coupled between the latch pins 74 for common movement together from the engaged position to the disengaged position. The shaft 76 spans in the lateral direction between the two latch pins 74 so that rotation of the shaft 76 causes the two latch pins 74 to be displaced between the engaged and disengaged positions. The shaft 76 is formed of plural telescoping sections arranged to be fixed in length by fasteners extending through cooperating apertures for accommodating different wheelchair widths as in the various crossbars noted above.

An actuator handle 78 is coupled to one of the handles 52 of the seat frame 14 for connection to one of the latch pins 74 by a suitable cable actuator 80 so that actuating the handle 78 causes one of the latch pins 74 to be displaced from the engaged position to the disengaged position through action of the cable actuator 80 while the other latch pin 74 is disengaged through action of the common shaft 76.

In further embodiments a motor unit may be mounted on the base frame 12 having one or more rotary output gears which are in meshing engagement with one or both of the racks 72 so that the seat frame 14 is displace between upright and fully-tilted positions under control of the motor. In this instance, no latch assembly is required if the motor is provided with suitable locking ability when deactivated. In this instance, controls for actuating the motor towards either of the fully-tilted or upright positions from any intermediate position can be provided both at the rear of the wheelchair 10 on the handles 52 of the seat frame 14 or at a suitable location on the wheelchair 10 which is readily accessible by a user seated in the seat frame 14.

Figure 11:
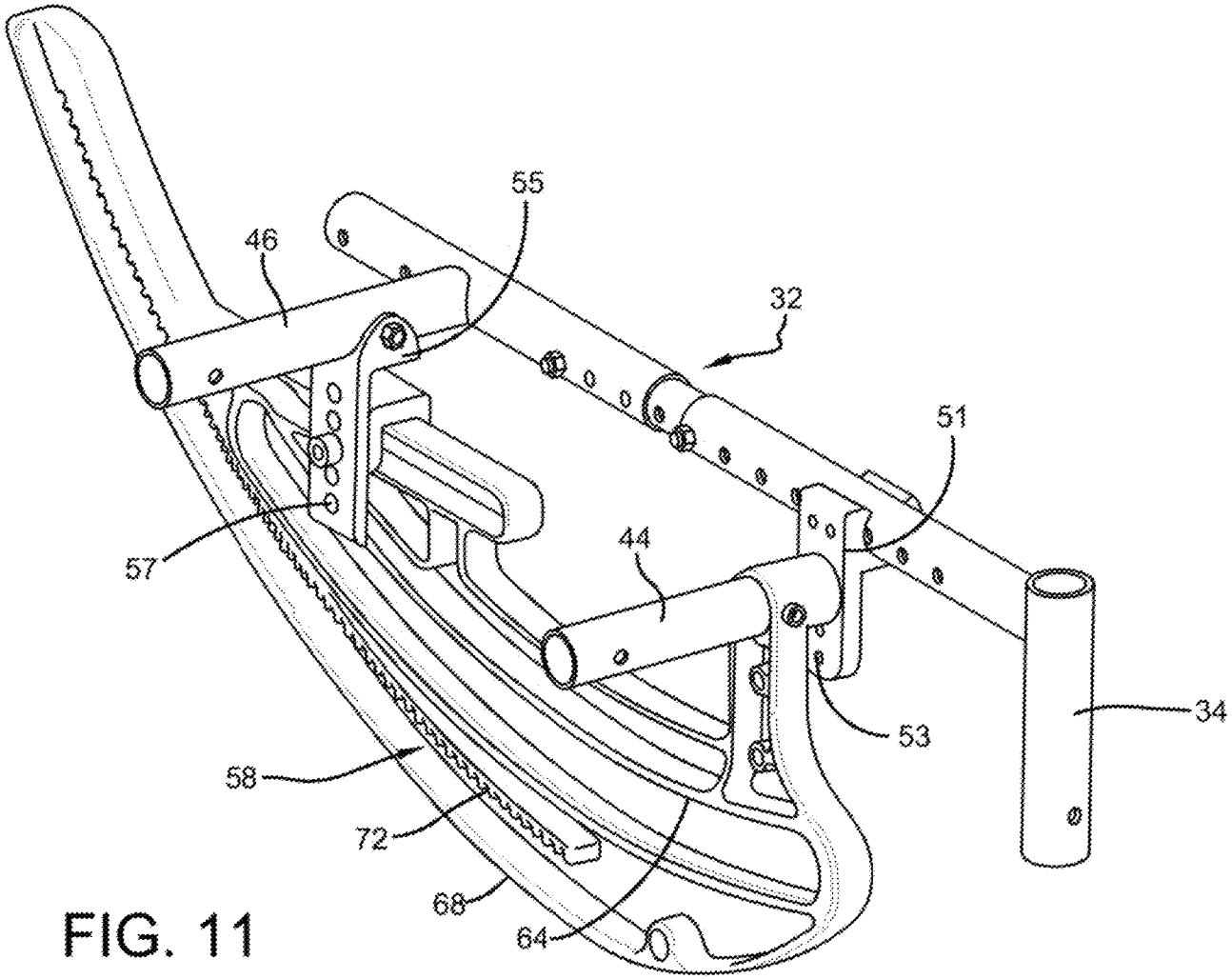
FIG. 11 is a perspective view of an alternative embodiment of one portion of the control frame of the support assembly which permits both adjustment in height and adjustment in the forward direction relative to the seat frame.

Turning now to the embodiment of FIG. 11, the front crossbar 44 of the seat frame 14 in this instance is arranged to be coupled to the side frame member 32 by a suitable bracket 51 which includes vertically spaced mounting apertures 53 to mount the front crossbar 44 thereon at different heights relative to the side frame members 32. The brackets remain adjustable along a length of the side frame members 32 as in the previous embodiment. The control bodies 58 of the control frame 56 remain coupled at respective front ends on the front crossbar 44 so that the control frame 56 is adjustable at the front end both in height and in longitudinal position in the forward direction relative to the seat frame 14.

At the rear end of the seat frame 14, brackets 55 can connect the rearward portion of the control bodies 58 to the rear crossbar 46 similarly include vertically spaced-apart mounting apertures 57 to allow height adjustment of the rear ends of the control bodies 58 relative to the rear crossbar 46 which is typically fixed relative to the side frame members 32. The brackets coupling the rear portions of the control bodies 58 to the rear crossbar maintain a longitudinal sliding adjustment of the control bodies 58 relative to the brackets to permit adjustment of the control bodies 58 in the forward direction relative to the seat frame 14 similarly to the previous embodiment.

In this manner, the center of gravity of the user seated on the seat frame 14 can be readily adjusted both in height and in the forward direction of the wheelchair 10 relative to the control frames 56 and the support assembly as a whole. As noted above, the adjustment and positioning of the connection of the control frame 56 to the seat frame 14 is typically performed at one time during initial set up and customization of the wheelchair 10 to the user to allow for the displacement of the center of gravity of the user on the seat frame 14 relative to the centers of curvature of the first and second controlling paths in the manner described above with regard to the previous embodiment as the seat frame 14 is displaced between fully-tilted and upright positions thereof.

The seat frame 14 is operable to support a seat and a wheelchair occupant sitting in the seat. The seat is not illustrated in the Figures since a variety of different seats can be used with embodiments of this disclosure. A center of gravity of the seat frame 14 and the seat and the wheelchair occupant is defined in operation.

The support assembly utilizes a plurality of control paths to direct the seat frame 14 in translating and rotating planar body motion. This motion defines and results in a fixed centrode. Planar movement of a body is often described using a plane figure moving in a two dimensional plane. The instant center of rotation, also called instantaneous center and instant center, is the point in or outside a body in the plane of movement undergoing planar movement that has zero velocity at a particular instant of time. At this instant the velocity vectors of the trajectories of other points in the body generate a circular field around this point which is identical to what is generated by a pure rotation. The instant center is the point in the moving plane around which all other points are rotating at a specific instant of time. The continuous movement of a plane has an instant center for every value of the time parameter. This generates a curve called the moving centrode. The points in the fixed plane corresponding to these instant centers form the fixed centrode.

Figure 10:
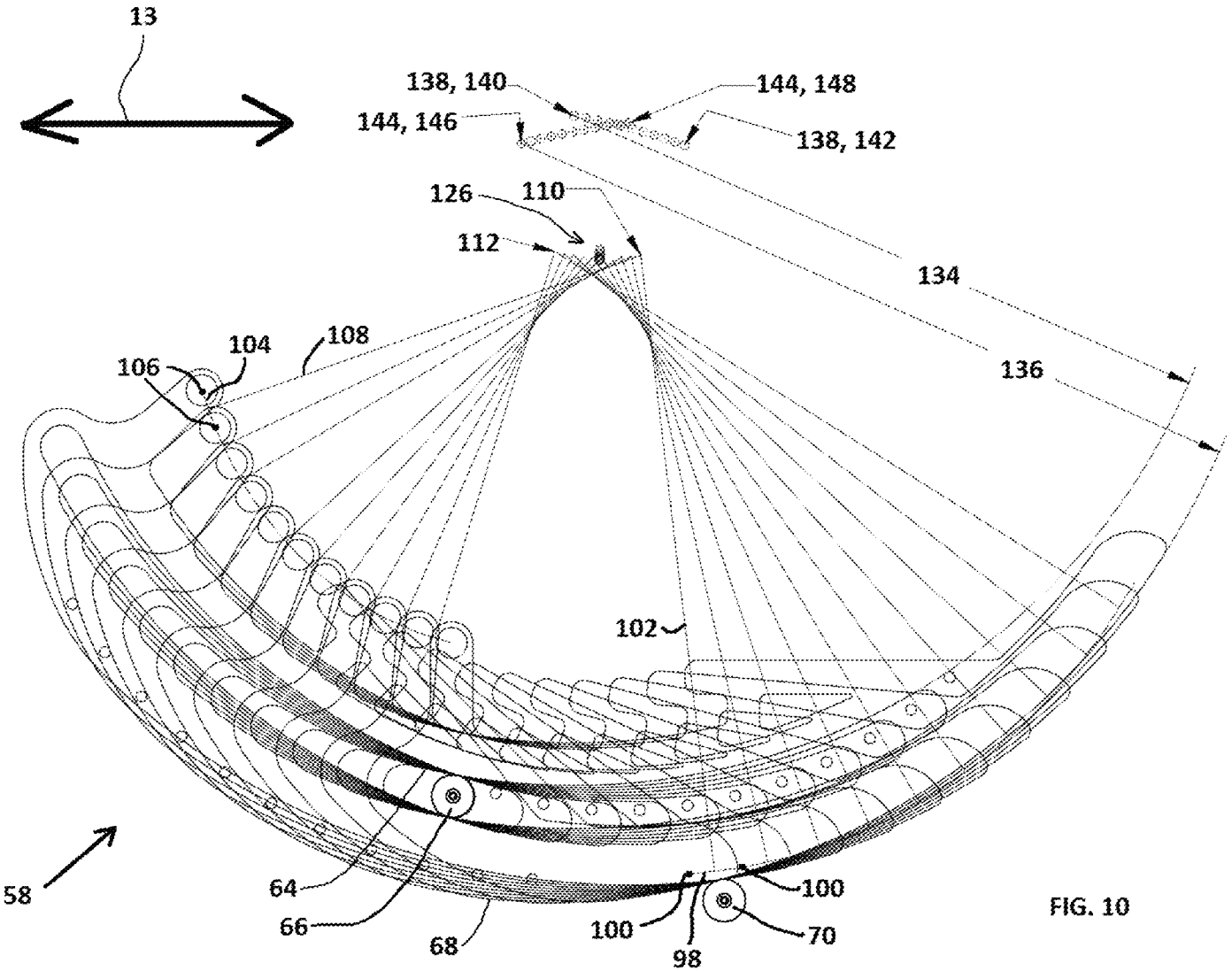
FIG. 10 is a first side elevational view of the support assembly in a variety of different positions including an upright position, a fully-tilted position and an intermediate position.

An instantaneous center can be obtained from two points fixedly associated with the moving body. First, more than one position of the moving body can be overlaid. This has been done in FIG. 10. FIG. 10 shows the control body 58 in a plurality of different positions. A first line 98 can connect the positions of a first point 100 fixedly associated with the control body 58. A second line 102 can be projected from the midpoint of the first line 98 and be perpendicular to the first line 98.

Next, a third line 104 can connect the positions of a second point 106 fixedly associated with the control body 58. A fourth line 108 can be projected from the midpoint of the third line 104 and be perpendicular to the third line 104. The exemplary lines 98 and 104 correspond to movement of the points 100 and 106 when the control body 58 moves from forty-five degrees of tilt to fifty degrees of tilt. The point of intersection between the lines 102 and 108, referenced at 110, can therefore be designated as the instantaneous center of movement of the control body 58 at fifty degrees of tilt.

The point referenced at 112 can be designated as the instantaneous center of movement of when the control body 58 moves from the upright position (no tilt) to five degrees of tilt. Each of the points of intersection shown between the points 110 and 112 in FIG. 10 can be designated as an instantaneous center of movement as the control body 58 incrementally moves five degrees of tilt. A line or curve interconnecting the points would be the fixed centrode. Thus, the fixed centrode is a kinematic term and is the path traced by the instantaneous center of rotation of a rigid body moving in a plane.

The support assembly of the exemplary embodiment utilizes a plurality of control paths to direct the seat frame 14 in translating and rotating planar body motion that defines the fixed centrode. The control body 58 is shown in FIG. 10 in various positions that correspond to movement of the seat frame 14 (not shown in FIG. 10). A line or curve interconnecting the points 110, 112 and the points of intersection arising between points 110, 112 is the exemplary fixed centrode of the movement of seat frame 14.

At least one of the plurality of control paths can be defined by a cam follower surface. In the exemplary embodiment shown in FIGS. 1-10, all of the plurality of control paths are defined by respective cam follower surfaces. In the exemplary embodiment, a first control path is defined by the surface of the arcuate track 64. A second control path is defined by the surface of the arcuate track 68. The tracks 64, 68 support the mass of the seat frame 14, any seat mounted on the seat frame 14, and an occupant of the wheelchair 10. The tracks 64, 68 rest on the rollers or followers 66, 70. The tracks 64, 68 act as cam followers and the rollers 66, 70 act as cams. It is noted that arrangements for controlling movement of the seat frame 14 other than cams and cam followers can be applied in other embodiments of this disclosure. For example, cylinders, levers, and other actuators can be applied in other embodiments.

The plurality of control paths are arranged such that the center of gravity is directable along a follower path during pivoting movement of the seat frame 14. The follower path has also been referred to as the controlled path herein. At least some embodiments of the invention reduce the likelihood that the center of gravity will be subjected to acceleration past one of the end limits of travel, the fully-tilted position and the upright position.

Figure 12:
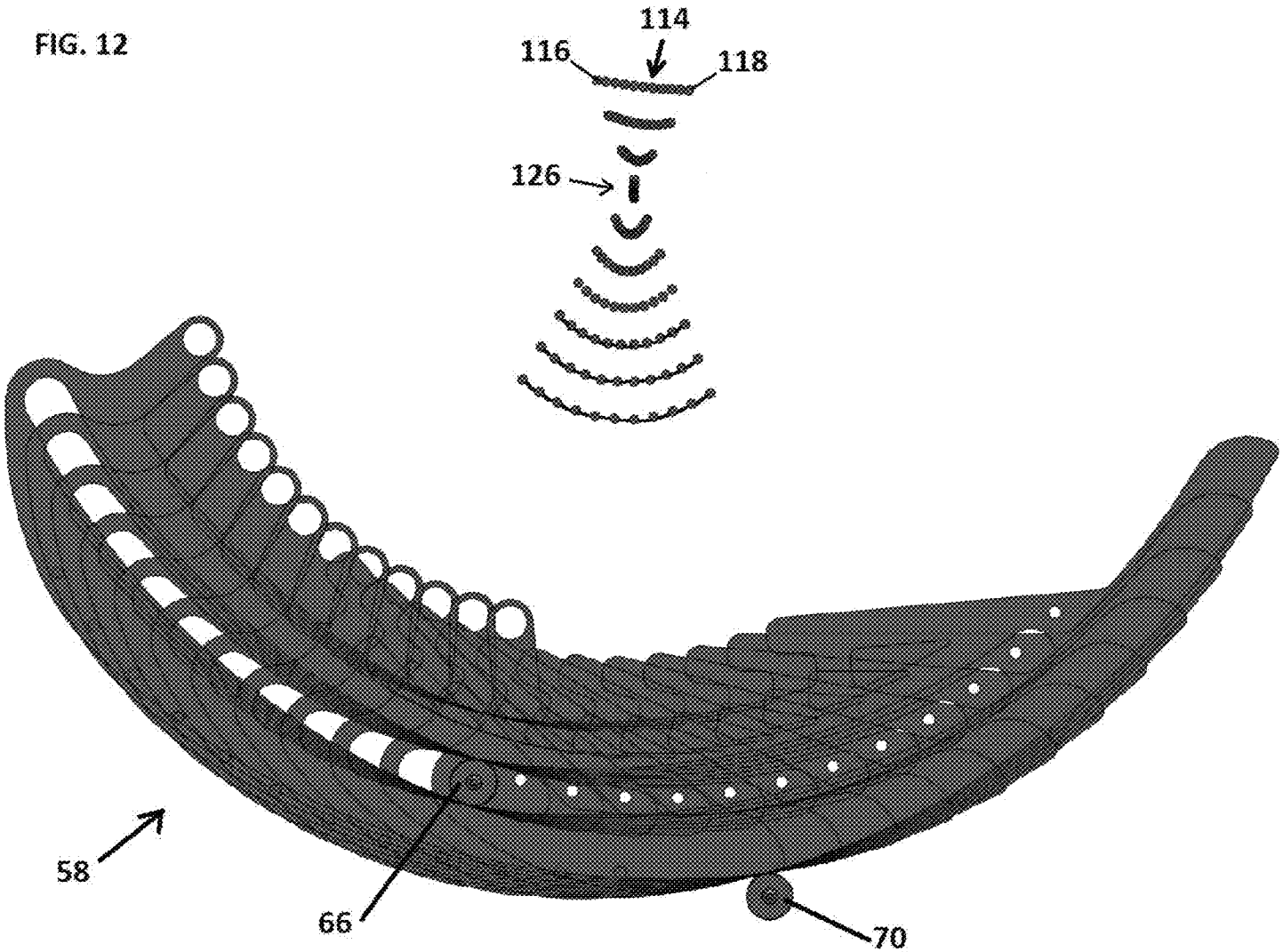
FIG. 12 is the first side elevational view of the support assembly in a variety of different positions including an upright position, a fully-tilted position and an intermediate position and also showing additional possible follower paths for a center of gravity.

The follower path can be substantially horizontal. The center of gravity would thus not be accelerated by gravity toward either end limit of travel. FIG. 12 shows a follower path 114 formed by a plurality of points or positions and is substantially horizontal. Point 116 is the location of a first exemplary center of gravity of the system when the seat frame (not shown in FIG. 12) is in the upright position. Point 118 is the location of the first exemplary center of gravity of the system when the seat frame is in the fully-tilted position. Another substantially straight follower path is referenced at 120 in FIG. 13. Point 122 is the location of a second exemplary center of gravity of the system when the seat frame (not shown in FIG. 13) is in the upright position. Point 124 is the location of the second exemplary center of gravity of the system when the seat frame is in the fully-tilted position.

The follower path can also be concave with the center of gravity vertically lower in the intermediate position than in at least one of the upright position and the fully-tilted position. The lowest point or position of the center gravity would lie between the end limits of travel. Thus, acceleration due to gravity would tend to urge the seat frame 14 away from the end limits of travel.

Figure 13:
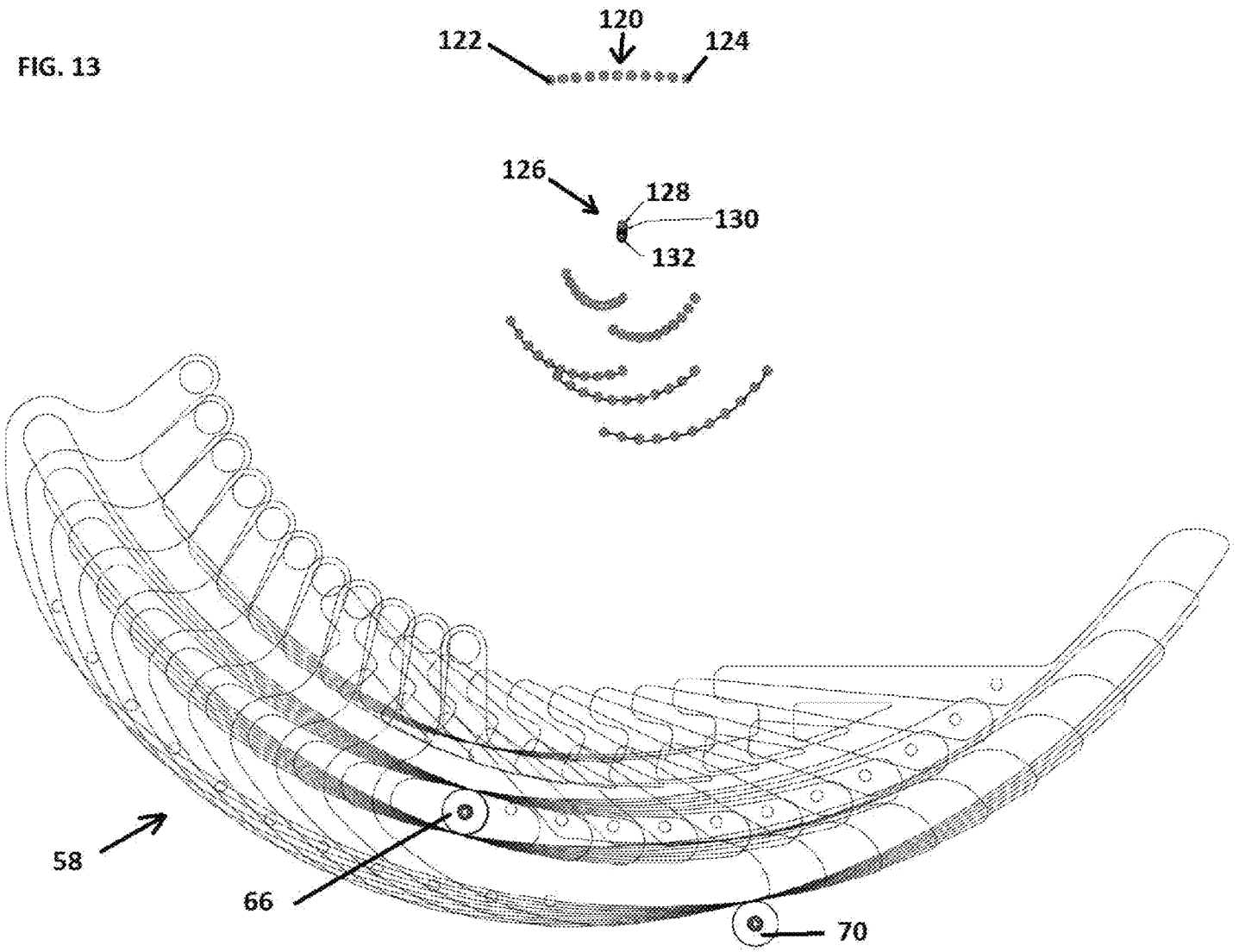
FIG. 13 is the first side elevational view of the support assembly in a variety of different positions including an upright position, a fully-tilted position and an intermediate position and also showing additional possible follower paths for a center of gravity.

FIGS. 12 and 13 shows several concave follower paths for different centers of gravity. A relatively tight follower path is referenced at 126 in FIGS. 10, 12 and 13. In FIG. 13, a point 128 along the path 126 is the location of a third exemplary center of gravity of the system when the seat frame (not shown in FIG. 13) is in the upright position. Point 130 is the location of the third exemplary center of gravity of the system when the seat frame is in the fully-tilted position. Point 132 is the location of the third exemplary center of gravity of the system when the seat frame is in the intermediate position and is the lowest of the points 128, 130, 132. In the exemplary embodiment, the intermediate position at point 132 is the lowest point of the center of gravity and occurs at twenty degrees of tilt. As shown in FIG. 10, the follower path 126 crosses the first centrode. Also, the follower path 126 extends vertically; the center of gravity has substantially no movement in the fore-aft direction during pivoting movement of the seat frame. This path is extremely stable.

Follower paths for other centers of gravity are shown in FIGS. 12 and 13. It is noted that the individual points or positions represent five degree gradients along the exemplary paths. For paths below the path 126, the right-most center of gravity position corresponds to the upright position of the seat frame 14 and the left-most center of gravity position corresponds to the fully-tilted position of the seat frame 14. For paths above the path 126, the left-most center of gravity position corresponds to the upright position of the seat frame 14 and the right-most center of gravity position corresponds to the fully-tilted position of the seat frame 14.

In the exemplary embodiment, both of the control paths 64, 68 are arcuate. The control paths 64, 68 have different radii. The radius of control path 64 is referenced at 134 in FIG. 10. The radius of control path 68 is referenced at 136. The center of the radius 134 is referenced at 138 in FIG. 10. The center 138 is further referenced at 140 when the seat frame is in the upright position. The center 138 is referenced at 142 when the seat frame is in the fully-tilted position. FIG. 10 also shows additional locations (unnumbered) of the center 138 during pivoting movement of the seat frame, between the locations 140 and 142.

The center of the radius 136 is referenced at 144 in FIG. 10. The center 144 is further referenced at 146 when the seat frame is in the upright position. The center 144 is referenced at 148 when the seat frame is in the fully-tilted position. FIG. 10 also shows additional locations (unnumbered) of the center 144 during pivoting movement of the seat frame, between the locations 146 and 148.

As shown in FIG. 10, the respective centers 138, 144 of the control paths 64, 68 are spaced from one another in the fore-aft direction 13. The centers 138, 144 of the control paths 64, 68 are aft of the exemplary center of gravity (directable along path 126) when the seat frame 14 is in the fully-tilted position. The centers 138, 144 of the control paths 64, 68 are forward of the exemplary center of gravity when the seat frame 14 is in the upright position. The centers 138, 144 of the control paths 64, 68 are above the exemplary center of gravity throughout movement of the seat frame 14 between the upright position and the fully-tilted position.

Figure 14:
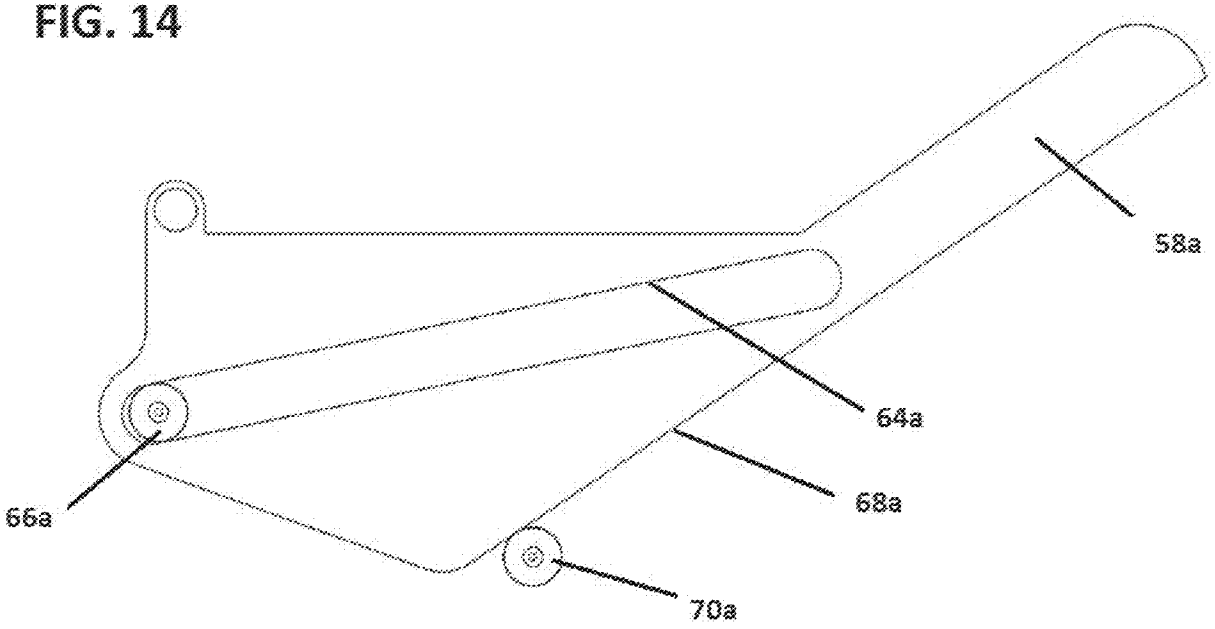
FIG. 14 is a side elevational view of a support assembly of an alternative embodiment of the disclosure.
Figure 15:
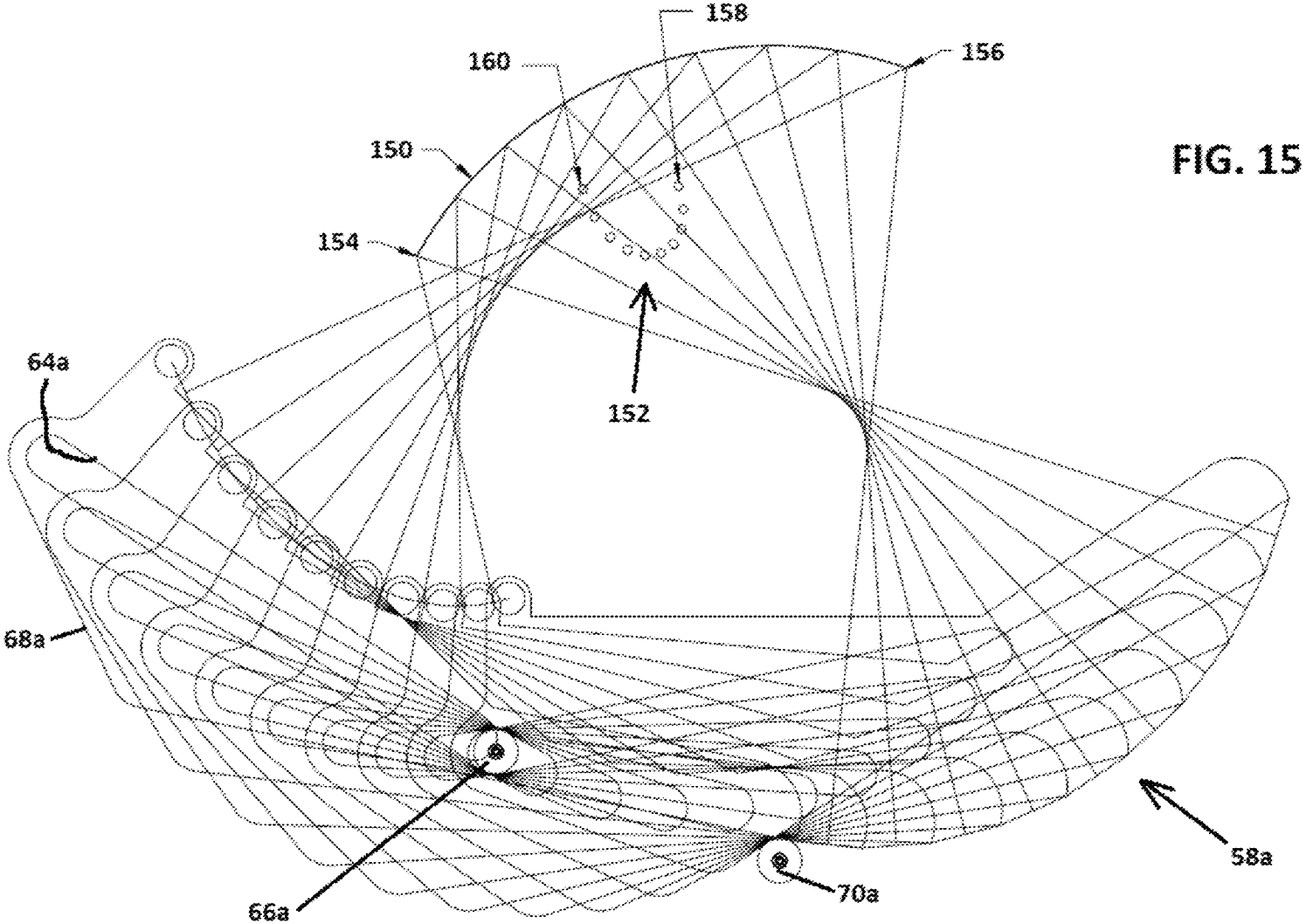
FIG. 15 is a side elevational view of the support assembly of the alternative embodiment of the disclosure in a variety of different positions including an upright position, a fully-tilted position and an intermediate position.

FIGS. 14 and 15 show an alternative embodiment of the disclosure. A control body 58*a* defining control paths 64*a* and 68*a* supported on rollers 66*a* and 70*a*. Both of the control paths 64*a*, 68*a* are straight. FIG. 15 references a follower path at 152 and a fixed centrode at 150. An instantaneous center associated with an initial pivoting movement of a seat frame from the upright position is referenced at 154. An instantaneous center associated with a final pivoting movement of the seat frame to the fully-tilted position is referenced at 156. A position of an exemplary center of gravity when the seat frame is in the upright position is referenced at 158. A position of the exemplary center of gravity when the seat frame is in the fully-tilted position is referenced at 160. As shown in the alternative embodiment, a follower path can be spaced from and extend below the fixed centrode. FIGS. 10, 12 and 13 show that embodiments can be practiced in which the follower path intersects the fixed centrode or extends above the fixed centrode.

In one or more embodiments, the seat frame can be adjustably positionable relative to the base frame in the fore-aft direction such that the position of the center of gravity is settable through adjustment along a single axis. The adjustment can create an alignment between the center of gravity and the fixed centrode. This alignment thereby creates stability within the limits of the range of motion of the system. The single axis would be an axis parallel to the fore-aft direction.

An embodiment of the invention can substantially increase the range of safe locations for the center of gravity. A safe location for the center of gravity can be a location in which pivoting movement is stable. Further, stable movement can be movement wherein the center of gravity does not experience excessive acceleration due to gravity, especially acceleration toward the end limits of travel.

Figure 16:
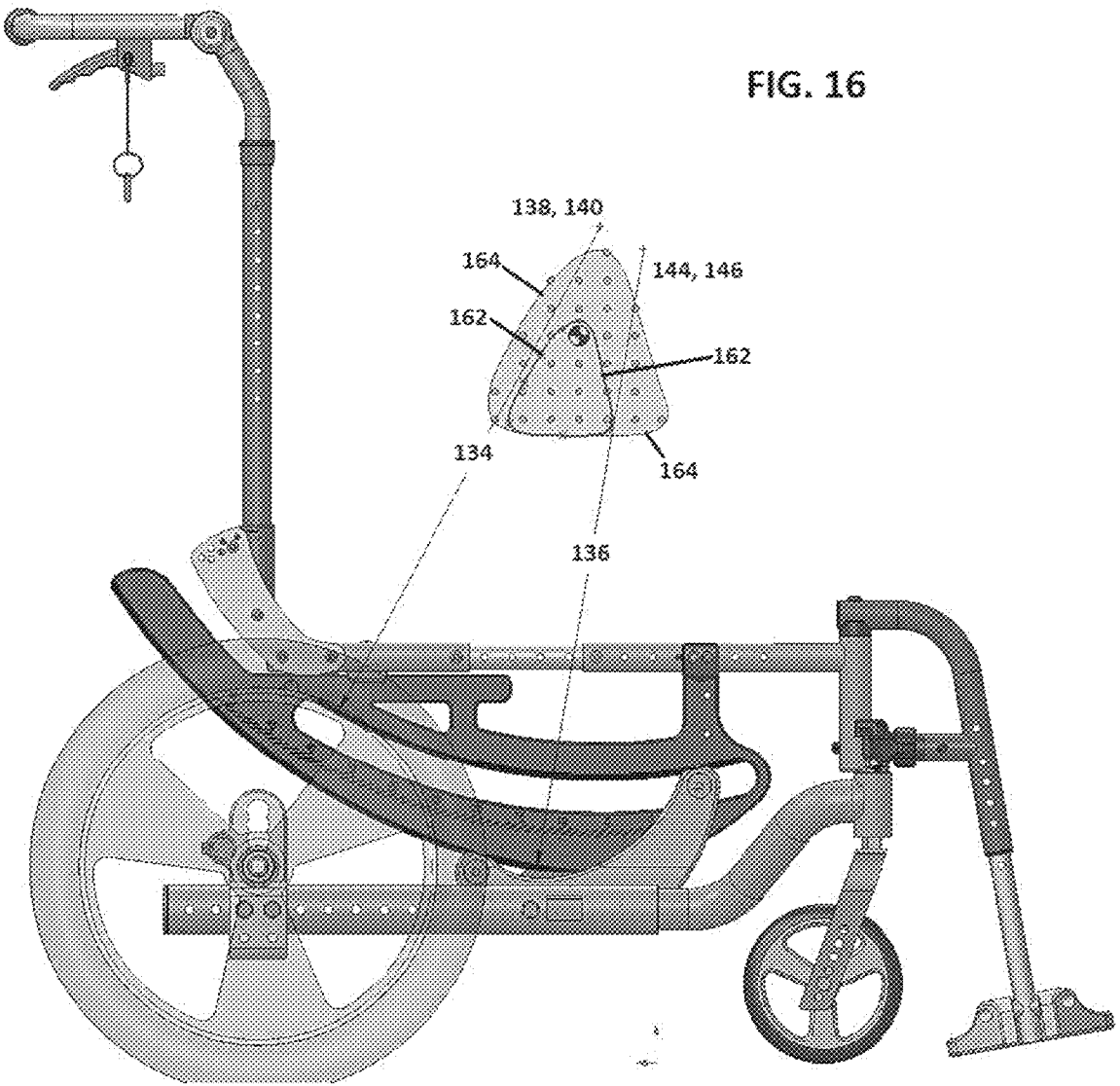
FIG. 16 is a side elevational view showing ranges of acceptable positions for a system center of gravity.

Again, an embodiment of the invention can substantially increase the range of safe locations for the center of gravity such that vertical adjustment is not required for many if not most occupants. FIG. 16 shows a first range of safe locations for the center of gravity for prior art system wherein a single control path is applied. This first range is enclosed by the line referenced at 162. An embodiment of the present disclosure can provide a second range of safe locations for the center of gravity; the second range is enclosed by the line referenced at 164. The vertical height of the second range 164 can be large enough to encompass a significant majority of likely heights for a center of gravity. Thus, it may only be necessary to adjust the center of gravity in the fore-aft direction for safe operation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A wheelchair comprising:

a base frame extending in a fore-aft direction and a lateral direction perpendicular to the fore-aft direction;

a plurality of wheels supporting said base frame for movement;

a seat frame operable to support a seat and a wheelchair occupant sitting in the seat;

a support assembly interconnecting said seat frame to said base frame for pivoting movement between an upright position, a fully-tilted position and an intermediate position between said upright position and said fully-tilted position, said support assembly utilizing a plurality of control paths to direct said seat frame in translating and rotating planar body motion that defines a fixed centrode;

wherein a center of gravity of said seat frame and the seat and the wheelchair occupant is definable in operation; and wherein said plurality of control paths are arranged such that the center of gravity is directable during pivoting movement of said seat frame along a follower path being at least one of substantially horizontal and concave with said center of gravity vertically lower in said intermediate position than in at least one of said upright position and said fully-tilted position.

2. The wheelchair of claim 1 wherein said follower path crosses said first centrode.

3. The wheelchair of claim 1 wherein said follower path extends vertically.

4. The wheelchair of claim 1 wherein said follower path is spaced from said fixed centrode.

5. The wheelchair of claim 4 wherein said follower path extends below said fixed centrode.

6. The wheelchair of claim 1 wherein both of said control paths are at least partially arcuate.

7. The wheelchair of claim 6 wherein both of said control paths are arcuate.

8. The wheelchair of claim 6 wherein said control paths have different radii.

9. The wheelchair of claim 6 wherein respective centers of said control paths are spaced from one another in the fore-aft direction.

10. The wheelchair of claim 6 wherein respective centers of said control paths are aft of the center of gravity when said seat frame is in said fully-tilted position.

11. The wheelchair of claim 10 wherein respective centers of said control paths are forward of the center of gravity when said seat frame is in said upright position.

12. The wheelchair of claim 6 wherein respective centers of said control paths are above the center of gravity throughout movement of said seat frame between said upright position and said fully-tilted position.

13. The wheelchair of claim 1 wherein both of said control paths are at least partially straight.

14. The wheelchair of claim 13 wherein both of said control paths are straight.

15. The wheelchair of claim 1 wherein said follower path is further defined as concave with said center of gravity vertically lower in said intermediate position than at both of said upright position and said fully-tilted position.

16. The wheelchair of claim 1 wherein said seat frame is adjustably positionable relative to said base frame in the fore-aft direction.

17. The wheelchair of claim 1 wherein at least one of said plurality of control paths is defined by a cam follower surface.

18. The wheelchair of claim 17 wherein all of said plurality of control paths are defined by respective cam follower surfaces.

19. A wheelchair comprising:

a base frame extending in a fore-aft direction and a lateral direction perpendicular to the fore-aft direction;

a plurality of wheels supporting said base frame for movement;

a seat frame operable to support a seat and a wheelchair occupant sitting in the seat;

a support assembly interconnecting said seat frame to said base frame for pivoting movement between an upright position, a fully-tilted position and an intermediate position between said upright position and said fully-tilted position, said support assembly utilizing a plurality of control paths to direct said seat frame in translating and rotating planar body motion that defines a fixed centrode;

wherein a center of gravity of said seat frame and the seat and the wheelchair occupant is definable in operation; and wherein said seat frame is adjustably positionable relative to said base frame in the fore-aft direction such that the position of the center of gravity is settable through adjustment along a single axis to create an alignment of the center of gravity with the fixed centrode and thereby creates stability within the limits of the range of motion of the system.

* * * * *